US006952669B2

(12) United States Patent
Hutchins

(10) Patent No.: US 6,952,669 B2
(45) Date of Patent: Oct. 4, 2005

(54) VARIABLE RATE SPEECH DATA COMPRESSION

(75) Inventor: Sandra Hutchins, Holtsville, NY (US)

(73) Assignee: Telecompression Technologies, Inc., Torrance, CA (US)

( * ) Notice: Subject to any disclaimer, the term of this patent is extended or adjusted under 35 U.S.C. 154(b) by 0 days.

(21) Appl. No.: 09/759,734

(22) Filed: Jan. 12, 2001

(65) Prior Publication Data

US 2002/0193987 A1 Dec. 19, 2002

(51) Int. Cl.[7] ..... G10L 11/04; G10L 19/04
(52) U.S. Cl. ..... 704/207; 704/219; 704/208
(58) Field of Search ..... 704/201, 205, 704/207–209, 219, 229–230, 221–223

(56) References Cited

U.S. PATENT DOCUMENTS

| | | | | |
|---|---|---|---|---|
| 4,160,131 A | | 7/1979 | Kaul et al. | |
| 4,980,917 A | | 12/1990 | Hutchins | |
| 5,200,993 A | | 4/1993 | Wheeler et al. | |
| 5,208,897 A | | 5/1993 | Hutchins | |
| 5,530,655 A | * | 6/1996 | Lokhoff et al. | 375/240.03 |
| 5,548,578 A | | 8/1996 | Matsune et al. | |
| 5,579,437 A | * | 11/1996 | Fette et al. | 704/262 |
| 5,608,446 A | | 3/1997 | Carr et al. | |
| 5,617,507 A | * | 4/1997 | Lee et al. | 704/200 |
| 5,623,575 A | * | 4/1997 | Fette et al. | 704/207 |
| 5,649,051 A | | 7/1997 | Rothweiler et al. | |
| 5,668,925 A | * | 9/1997 | Rothweiler et al. | 704/220 |
| 5,778,342 A | | 7/1998 | Erell et al. | |
| 5,809,459 A | * | 9/1998 | Bergstrom et al. | 704/223 |
| 5,940,479 A | | 8/1999 | Guy et al | |
| 6,075,783 A | | 6/2000 | Voit . | |
| 6,078,880 A | | 6/2000 | Zinser, Jr. et al. | |
| 6,078,884 A | | 6/2000 | Downey | |
| 6,138,092 A | * | 10/2000 | Zinser et al. | 704/223 |
| 6,141,329 A | * | 10/2000 | Turner | 348/388.1 |
| 6,185,525 B1 | * | 2/2001 | Taubenheim et al. | 704/211 |
| 6,298,045 B1 | | 10/2001 | Pang et al. | |
| 6,339,594 B1 | | 1/2002 | Civanlar et al. | |

OTHER PUBLICATIONS

Knuth, D., *The Art of Computer Programming,* vol. 2, Addisson–Wesley, New York, 1998. (p. 27).

Deller, John R., Hansen, John H. L., Proakis, John G., *Discrete Time Proecssing of Speech Signals,* pp. 292–296, IEEE Press, New York, New York, 1993.

O'Shaughnessy, Douglas, *Speech Communication: Human and Machine,* p. 356, Addison–Wesley, New York, New York, 1987.

Madisetti, Vijay, and Williams, Douglas, *The Digital Signal Processing Handbook,* CRC Press, Boca Raton, Florida, 1998. (CHAPTERS 44 –51).

* cited by examiner

*Primary Examiner*—Richemond Dorvil
*Assistant Examiner*—A. A. Armstrong
(74) *Attorney, Agent, or Firm*—Blakely Sokoloff Taylor & Zafman

(57) ABSTRACT

A device is presented that includes an encoder. The encoder compresses a plurality of signals at variable frame rates based on a plurality of prioritized parameters to reduce signal bandwidth while preserving perceptual signal quality. Also presented is a device that includes a decoder. The decoder decompresses a plurality of compressed signals at variable rates based on a plurality of prioritized parameters to reduce signal bandwidth while preserving perceptual signal quality.

42 Claims, 8 Drawing Sheets

VARIABLE RATE SPEECH DATA COMPRESSION

BACKGROUND OF THE INVENTION

1. Field of the Invention

The present invention relates to processing of digitized speech and more particularly to compression of voice data to reduce bandwidth required to transmit the speech over digital transmission media while preserving perceptual speech quality.

2. Background of the Art

With the current growth of digital transmission and the convergence of voice and data networks world-wide, digitized speech signals place increasing bandwidth burdens on digital networks. Existing fixed and variable rate speech compression techniques suffer from poor speech quality in the reconstructed speech and lack the flexibility to adapt dynamically to changing network bandwidth constraints.

Contemporary digital transmission environments beneficially accommodating variable data rates include multi-channel long-haul telecom, and voice over Internet Protocol (IP) applications.

The current trend in IP networks toward a quality-of-service (QoS) based rate structure is supported to only limited extents by existing voice compression systems, which generally offer a limited range of data rates and output speech quality.

SUMMARY

The invention relates to a device that includes an encoder. The encoder compresses a plurality of signals at variable rates based on a plurality of prioritized parameters to reduce signal bandwidth while preserving perceptual signal quality.

Also the invention relates to a device that includes a decoder. The decoder decompresses a plurality of compressed signals at variable rates based on a plurality of prioritized parameters to reduce signal bandwidth while preserving perceptual signal quality.

BRIEF DESCRIPTION OF THE DRAWINGS

The invention is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

DETAILED DESCRIPTION OF AN EMBODIMENTS

The invention generally relates to the efficient transmission of digitized speech while preserving perceptual speech quality. This is accomplished by using an Encoder at the transmitting end and Decoder at the receiving end of a digital transmission medium. Referring to the figures, exemplary embodiments of the invention will now be described. The exemplary embodiments are provided to illustrate the invention and should not be construed as limiting the scope of the invention.

Figure 1:
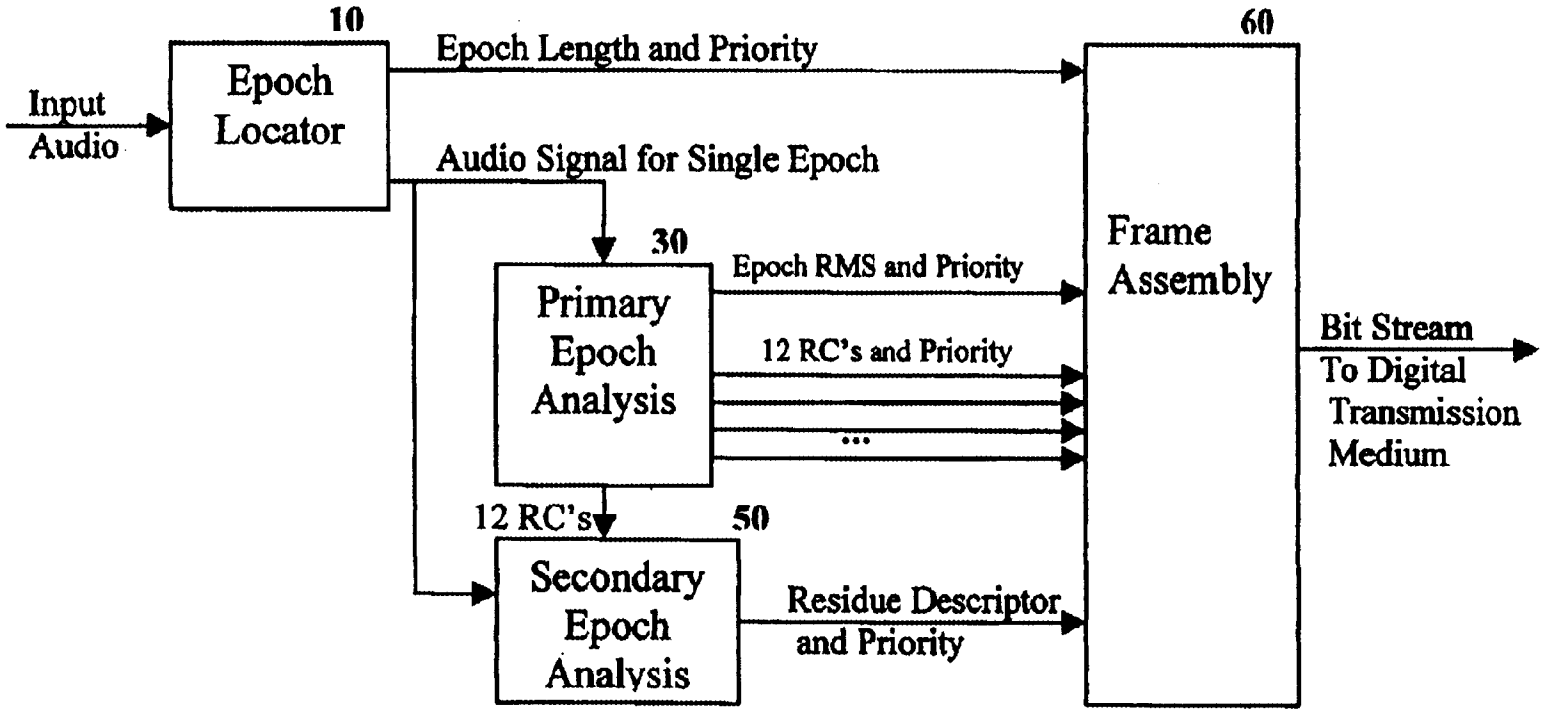
FIG. 1 illustrates a block diagram of an embodiment of the invention having a Variable Rate Speech Encoder.

FIG. 1 illustrates a block diagram of an Encoder in one embodiment of the invention. The Encoder comprises Epoch Locator unit 10 to identify segments of an input signal for further analysis, Primary 30 and Secondary 50 Analysis units to extract parameters that describe signal segments and associate a priority value with each parameter, and Frame Assembly unit 60 to prepare the parameters for transmission.

While the following discussion relates to the variable rate transmission and reception of compressed speech signals over a digital transmission medium, one should note that other types of signals can benefit from the embodiments of the invention also, such as audio associated with video streaming signals. In a transmitting telephone, an input channel of speech generally originates as an analog signal. In one embodiment, this signal is converted to a digital format (by an Analog to Digital converter) and presented to the Encoder. The conversion from analog to digital formats may take place in the immediate physical vicinity of the Encoder, or digital signals may be forwarded (e.g. over the Public Switched Telephone Network (PSTN)) from remote locations to the Encoder. When encoding (compressing) a given channel of digitized speech, frames of output (channel) data appear at the output of the Encoder at a variable rate that is determined by activity in the input audio signal. In one embodiment, each frame of data sent to the digital transmission medium consists of an encoding of (typically) 15 parameters describing an epoch (segment) of the input audio signal.

The Encoder compresses speech at a variable rate, which allocates available bandwidth to those portions of the digital signal that are most significant perceptually. The parameters that describe an epoch are ordered from most important to least important in their influence on perceived speech quality and a Priority Value is associated with each parameter detailing its importance in the current audio context for reconstructed speech audio quality. The priority flags are not sent to the receiving end, but are used in one of two ways:

(1) Other systems, external to the present invention, which manage the traffic over the digital medium may use the Priority Values to drop parameters from the transmitted bit stream thus further reducing bandwidth with minimal impact on speech quality.

(2) Other systems, external to the present invention, which manage the traffic over the digital medium may signal the present invention to use the Priority Values to drop parameters from its output bit stream thus further reducing bandwidth with minimal impact on speech quality.

In situations in which the Encoder and traffic management systems are physically co-located or share a high bandwidth interface, it may be advantageous to employ the first method. Such systems include the Network Manager scenario described in copending patent application entitled TELECOMMUNICATION DATA COMPRESSION APPA- RATUS AND METHOD Ser. No. 09/759,733 filed on Jan. 12, 2001, now U.S. Pat. No. 6,721,282. In situations in which the Encoder and traffic management systems are not physically co-located or share only a low bandwidth interface, it may be advantageous to employ the second approach. Such systems include cellular telephone networks in which the Encoder would advantageously reside in the end user's cellular telephone while network traffic management functions would be performed centrally or at the cell level in the network.

Figure 3:
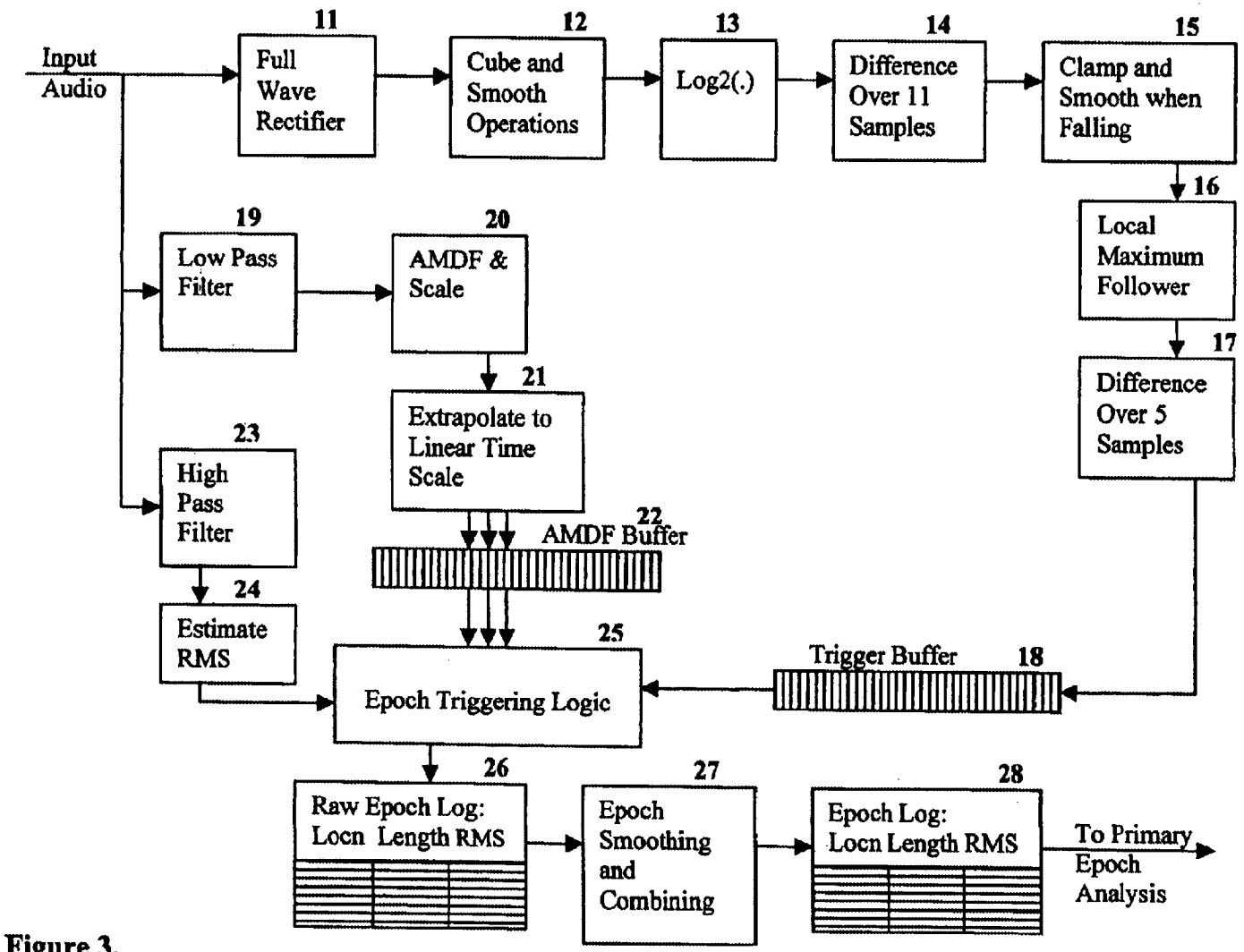
FIG. 3 illustrates a signal flow diagram of an Epoch Locator portion of the Encoder illustrated in FIG. 1.

FIG. 3 illustrates signal flow in Epoch Locator 10. In one embodiment Epoch Locator 10 identifies segments (epochs) in input speech that correspond to individual periods of a speaker's pitch. During intervals of voiced speech (when the speaker's vocal chord is vibrating and sending pulses of air at a regular rate into the upper vocal tract, either real-time or synthesized) Epoch Locator 10 identifies the points at which these pulses occur. During intervals of unvoiced speech (when the vocal chords are not active or synthesized speech is not active) Epoch Locator 10 identifies random segments for analysis. The identification of the putative pulse locations involves detecting sudden increases in relative signal energy. The Epoch Locator signal flow described here is a modification of the pitch tracking described in U.S. Pat. Nos. 4,980,917 and 5,208,897.

Illustrated in FIG. 3, Full Wave Rectifier 11 operates on the Input Audio Signal time series, $\{S_n\}$, by taking the mathematical absolute value to produce the time series $\{|S_n|\}$ in one embodiment. The time series or signal $\{S_n\}$ is assumed to represent a standard PSTN speech signal sampled at 8,000 samples per second and converted from the PSTN standard of Mu-law or A-law encoding to a linear 12 bit format. In one embodiment, Cube and Smooth Operations 12 operate on $\{|S_n|\}$ to produce the time series $\{Y_n\}$ according to the following equation:

$$Y_n=(15*Y_{n-1}+(\text{Minimum}(2047, |S_n|)^3)/2048)/16 \quad \text{(Eq. 1)}$$

In one embodiment, Log2 operation 13 operates on $\{Y_n\}$ to produce $\{y_n\}$ according to the following equation:

$$y_n=32*\text{Log2}(Y_n) \quad \text{(Eq. 2)}$$

In one embodiment, Difference Over 11 Samples Operation 14 operates on $\{y_n\}$ to produce $\{D_n\}$ according to the following equation:

$$D_n=y_n-(y_{n-1}+y_{n-2}+y_{n-3}+y_{n-4}+y_{n-5}+y_{n-6}+y_{n-7}+y_{n-8}+y_{n-9}+y_{n-10})/10 \quad \text{(Eq. 3)}$$

In one embodiment, Clamp and Smooth When Falling operation 15 operates on $\{D_n\}$ to produce $\{x_n\}$ according to the following equations:

$$D'_n=\text{Maximum}(\text{Minimum}(64, D_n),-128)$$

$$x'_n = \begin{cases} (4*D'_n+7*x'_{n-1})/8 & \text{if } 4*D'_n < x'_{n-1} \text{ and } x'_{n-1} > 32 \\ (4*D'_n+15*x'_{n-1})/16 & \text{if } 4*D'_n < x'_{n-1} \text{ and } x'_{n-1} <= 32 \\ 4*D'_n & \text{if } 4*D'_n >= x'_{n-1} \end{cases} \quad \text{(Eq. 4)}$$

$$x_n = x'_n/4$$

In one embodiment, Local Maximum Follower 16 operates on $\{x_n\}$ to produce $\{M_n\}$ according to the following equations:

$$\begin{aligned} &\text{If } x_n > M'_{n-1} \\ &\quad M'_n = x_n \\ &\quad M''_n = 16*M'_n+8 \\ &\text{If } x_n <= M'_{n-1} \\ &\quad M'_n = M''_{n-1}/16 \\ &\quad M''_n = M''_{n-1}-M'_n \\ &M_n = \begin{cases} M'_n & \text{if } M'_n >= 1 \\ 1 & \text{if } M'_n < 1 \end{cases} \end{aligned} \quad \text{(Eq. 5)}$$

In one embodiment, Difference Over 5 Samples operation 17 operates on $\{M_n\}$ to produce $\{t_n\}$ according to the following equation:

$$t_n=M_n-[(M_{n-1}+M_{n-2}+M_{n-3}+M_{n-4})/4]-3 \quad \text{(Eq. 6)}$$

The signal $\{t_n\}$ generally shows sharp positive going peaks at the pulse locations. The signal $\{t_n\}$ is stored in Trigger Buffer 18 for later use as the primary driver of Epoch Triggering Logic 25.

The raw indications of possible pulse locations reflected in Trigger Buffer 18 are subject to errors as a result of noise in the input signal. To counter the effect of the noise on pulse location accuracy, in one embodiment an Average Magnitude Difference Function (AMDF) is computed once every 64 samples. The nulls in this function occur at points that correspond to strong periodicities in the input signal. In one embodiment, prior to computing the AMDF the input audio signal $\{S_n\}$ is subjected to Low Pass Filter 19 to produce a signal $\{Z_n\}$ according to the following equations:

$$\begin{aligned} z'_n&=0.5928955*S_n+0.0849914*z'_{n-1}+0.5928955*S_{n-1} \\ z''_n&=0.8*z'_n \\ z'''_n&=0.5928955*z''_n+0.0849914*z'''_{n-1}+0.5928955*z''_{n-1} \\ z_n&=0.8*z'''_n \end{aligned} \quad \text{(Eq. 7)}$$

The AMDF function values to be used while processing triggers for samples N to N+63 are computed from $\{Z_n\}$ as 49 values $\{a'_k:k=0,1,2, \ldots 48\}$ as follows:

$$a_k = \sum_{j=0}^{49} |Z_{N+j-halflag(k)+2} - Z_{N+j+halflag(k)+2}| \quad \text{(Eq. 8)}$$

where in one embodiment, halflag( ) is given by Table 1.

TABLE 1

| | | | | | | | | | | |
|---|---|---|---|---|---|---|---|---|---|---|
| k | 0 | 1 | 2 | 3 | 4 | 5 | 6 | 7 | 8 | 9 |
| halflag (k) | 8 | 9 | 10 | 11 | 12 | 13 | 14 | 15 | 16 | 17 |
| k | 10 | 11 | 12 | 13 | 14 | 15 | 16 | 17 | 18 | 19 |
| halflag (k) | 18 | 19 | 20 | 21 | 22 | 23 | 24 | 25 | 26 | 27 |
| k | 20 | 21 | 22 | 23 | 24 | 25 | 26 | 27 | 28 | 29 |
| halflag (k) | 28 | 29 | 30 | 31 | 32 | 34 | 36 | 38 | 40 | 42 |
| k | 30 | 31 | 32 | 33 | 34 | 35 | 36 | 37 | 38 | 39 |
| halflag (k) | 44 | 46 | 48 | 50 | 52 | 54 | 56 | 58 | 60 | 62 |
| k | | 40 | 41 | 42 | 43 | 44 | 45 | 46 | 47 | 48 |
| halflag (k) | | 64 | 68 | 72 | 76 | 80 | 84 | 88 | 92 | 96 |

The values of halflag( ) are roughly uniformly spaced on a logarithmic scale. The actual lag values used in the AMDF are 2*halflag( ) and span the range from 16 to 192. The range of 16 samples to 192 samples corresponds to possible pitch frequencies of 500 Hz down to 41.7 Hz at the 8,000 Hz sampling rate.

In one embodiment, the Raw AMDF $\{a'_k\}$ is then normalized to produce $\{a_k\}$ as follows:

MaxMag=Maximum($\{a'_k\}$)

MinMag=Minimum($\{a'_k\}$)

Range=MaxMag−MinMag $$a_k=(10*(a'_k-\text{MinMag}))/\text{Range for } k=0,1,\ldots,48 \quad \text{(Eq. 9)}$$

The Normalized AMDF $\{a_k\}$ has values ranging from 0 to 10 with the zeroes or nulls at points corresponding to the lags (frequencies) exhibiting the most pronounced periodicities in the low pass filtered version of the input signal. The null point with the lowest index (highest frequency) is then widened by setting the two neighboring points on either side to zero. By definition the first null begins at index p and extends to index q that is $$a_k=0 \text{ for } k \text{ in } p \text{ to } q$$

and $$a_k>0 \text{ for } k<p$$

The null is widened by the following operation:

$$a_{p-1}=0 \text{ if } p>0$$

$$a_{p-2}=0 \text{ if } p>1$$

$$a_{q+1}=0 \text{ if } q<47$$

$$a_{q+2}=0 \text{ if } q<46 \quad \text{(Eq. 10)}$$

In one embodiment Extrapolate to Linear Time Scale operation 21 is then performed to construct an AMDF approximation $\{A_k;\ k=0,1,\ldots,219\}$ on all possible lag values from 0 to 200 with the following operation (expressed in C programming code):

```
k=0;
for(j=0;j<221;j++)
{
if((j>2*halflag(k))&&(k<48))k++;
A[j]=a[k];
}
```

(Eq. 11)

The AMDF approximation $\{A_k;\ k=0,1,\ldots,220\}$ is then written to AMDF Buffer 22 for use in Epoch Triggering Logic 25.

In one embodiment Epoch Trigger Logic 25 also employs an RMS (root mean square) estimate $\{erms_n\}$ computed from a High Pass Filtered version of the Input Signal $\{S_n\}$. High Pass Filter 23 computes a signal $\{p_n\}$ from $\{S_n\}$ as follows:

$$p_n=0.8333*(S_n-S_{n-1}+0.4*S_{n-2}) \quad \text{(Eq. 12)}$$

In one embodiment Estimate RMS function 24 computes $\{erms_n\}$ from $\{p_n\}$ according to the following equation:

$$erms_n=(127*erms_{n-1}+p_n)/128 \quad \text{(Eq. 13)}$$

Epoch Triggering Logic 25 examines the trigger buffer and the AMDF approximation in the AMDF buffer to determine if the start of a new Epoch should be declared at a point, n, in time where n falls in the range N to N+63 to be used with the current contents of the AMDF buffer computed as in Eq. 8 above. In the Epoch Triggering Logic a variable, PeriodSize, is defined as the time in samples since the most recent trigger (epoch start). In one embodiment two trigger signals are considered. The first is simply the trigger signal recorded in Trigger Buffer 18; the second is the value from Trigger Buffer 18 plus 2 and minus the corresponding value from AMDF Buffer 22. The operation of adjusting by the AMDF value serves to pull down spurious triggers which do not correspond to strong periodicities in the input signal. The Epoch Triggering Logic computes these two trigger signals for the current point n and for 19 points (n+j; j=1 to 19) in the future. If a trigger point appears in the near future that is stronger than the current point, triggering at the current point is suppressed to wait for the stronger trigger. To this end the following computations are performed to construct arrays of the trigger values $\{tr_k;\ k=0 \text{ to } 19\}$ and adjusted trigger values $\{ta_k;k=0 \text{ to } 19\}$ for the current point and 19 points in the future, recalling from Eq. 6 that Trigger Buffer 18 contains the signal $\{t_n\}$ and from Eq. 11 that the AMDF Buffer contains the signal $\{A_k;\ k=0 \text{ to } 220\}$:

$$tr_k=t_{n+k} \text{ for } k=0 \text{ to } 19$$

$$ta_k=t_{n+k}+2-A_{PeriodSize+k} \text{ for } k=0 \text{ to } 19$$

$$\text{Maxtr}=\text{Maximum}(tr_k)$$

$$\text{Maxta}=\text{Maximum}(ta_k) \quad \text{(Eq. 14)}$$

In one embodiment triggering (declaring the start of a new epoch) occurs when the following conditions are met:

PeriodSize=200 OR ((Maxtr<=$tr_0$+5 OR Maxta<=$ta_0$) AND ($tr_0$>4 OR $ta_0$>=0) AND PeriodSize>=16)

When triggering occurs an addition is made to the next available space in Epoch Log 26 to record the location, n, at which the trigger occurred, the time, PeriodSize, since the previous trigger (the Epoch Length), and the value of $estrms_n$ as computed in Eq. 13.

In one embodiment whenever the current value of PeriodSize plus the sum of the Epoch Lengths in the Raw Epoch Log exceeds 344 samples, Epoch Smoothing and Combining operation 27 is activated. Epoch Smoothing and Combining 27 creates Epoch Log 28 from Raw Epoch Log 26 by examining and modifying the first few entries in Raw Epoch Log 26 and then dispatching the first Epoch in Epoch Log 28 to Primary Epoch Analysis unit 30.

By definition Raw Epoch Log 26 is a structure with N entries and three fields: Location, Length, and EstRms, that is:

RawEpochLog.Location$_k$ for k=0,1, . . . , N−1

RawEpochLog.Length$_k$ for k=0,1, . . . , N−1

RawEpochLog.EstRms$_k$ for k=0,1, . . . , N−1

Epoch Log 28 is a similar structure that is initially set equal to Raw

Epoch Log 26, that is:

$$\text{EpochLog.Location}_k=\text{RawEpochLog.Location}_k \text{ for } k=0,1,\ldots,N-1$$

$$\text{EpochLog.Length}_k=\text{RawEpochLog.Length}_k \text{ for } k=0,1,\ldots,N-1$$

$$\text{EpochLog.EstRms}_k=\text{RawEpochLog.EstRms}_k \text{ for } k=0,1,\ldots,N-1 \quad \text{(Eq. 15)}$$

In one embodiment Epoch Smoothing and Combining 27 comprises 6 operations, the first two of which are designed to enhance speech quality by smoothing (correcting presumed errors) in successive Epoch Lengths, the next 3 of which are designed to combine epochs in the interest of reducing channel bit rate by reducing frame rate, and the last one of which enhances quality by extending the epoch length pattern indicative of voiced speech for a short distance into the following unvoiced speech area. Each operation operates on and potentially modifies Epoch Log 28 as constructed in Eq. 15 above.

In one embodiment in one operation of Epoch Smoothing missed triggers are hypothesized and inserted into the log. The conditions for executing this operation are:

$EpochLog.Length_1<200$ AND $NearTo(EpochLog.Length_0, EpochLog.Length_1/2, 1.3)$ AND $NearTo(EpochLog.Length_2, EpochLog.Length_1/2, 1.3)$ Where the function NearTo(a,b,z) is defined as follows:

NearTo(a,b,z)={True if Max(a,b)/Min(a,b)<=z

{False otherwise

When these conditions are met the following modifications are performed to split the second log entry into two entries:

Shift log entries with indicies>=2 1 slot higher $EpochLog.Length_2=EpochLog.Length_1/2$ $EpochLog.Length_1=EpochLog.Length_1-EpochLog.Length_2$ $EpochLog.EstRms_2=EpochLog.EstRms_1$ $EpochLog.Location_2=EpochLog.Location_1$ $EpochLog.Location_1=EpochLog.Location_0+EpochLog.Length_1$

N=N+1

In another operation of Epoch Smoothing, assumed false triggers are removed and combined with neighboring epochs. The conditions for executing this operation are:

$EpochLog.Length_1+EpochLog.Length_2<200$ AND $NearTo(EpochLog.Length_0, EpochLog.Length_1+EpochLog.Length_2, 1.3)$

AND $NearTo(EpochLog.Length_3, EpochLog.Length_1+EpochLog.Length_2, 1.3)$

When these conditions are met the following modifications are performed to combine the epochs at indices 1 and 2 into a single epoch:

$EpochLog.Length_1=EpochLog.Length_1+EpochLog.Length_2$ $EpochLog.Location_1=EpochLog.Location_2$ Shift log entries with indicies>=2 1 slot lower

N=N−1

In one operation of Epoch Combining two short Epochs of similar length and any amplitude are combined into a single long epoch that is labeled by the system as a double epoch. The conditions for executing this operation are:

$EpochLog.Length_0<=50$ AND $EpochLog.Length_1<=50$ AND $(|EpochLog.Length_0-EpochLog.Length_1|<=2)$ When these conditions are met the following modifications are performed to combine the epochs with indices 0 and 1 into one epoch that is flagged as a Double Epoch by the addition of 200 to its length:

$EpochLog.Length_0=200+EpochLog.Length_0+EpochLog.Length_1$ $EpochLog.Location_0=EpochLog.Location_1$ Shift log entries with indicies>=1 one slot lower

N=N−1

In another operation of Epoch Combining two short Epochs of dissimilar length and low amplitude are combined into a single long epoch that is labeled by the system as a Double Epoch. The conditions for executing this operation are:

$EpochLog.Length_0+EpochLog.Length_1<=100$ AND $EpochLog.EstRms_0<=60$ AND $EpochLog.EstRms_1<=60$ When these conditions are met the following modifications are performed to combine the epochs with indices 0 and 1 into one epoch that is flagged as a Double Epoch by the addition of 200 to its length:

$EpochLog.Length_0=200+EpochLog.Length_0+EpochLog.Length_1$ $EpochLog.Location_0=EpochLog.Location_1$ Shift log entries with indicies>=1 one slot lower

N=N−1

In another operation of Epoch Combining two medium length Epochs of similar or dissimilar length, low amplitude, and presumed unvoiced speech are combined into a single long epoch that is not labeled as a double epoch. This operation is repeated one more time to provide more combining and hence more data rate reduction. The conditions for executing this operation employ the variable Previous_rc1 which is exported from Primary Epoch Analysis unit 30. They are:

$EpochLog.Length_0+EpochLog.Length_1<=200$ AND $EpochLog.EstRms_0<=60$ AND $EpochLog.EstRms_1<=60$ AND Previous_rc1<0

When these conditions are met the following modifications are performed:

$EpochLog.Length_0=EpochLog.Length_0+EpochLog.Length_1$ $EpochLog.Location_0=EpochLog.Location_1$ Shift log entries with indicies>=1 one slot lower

N=N−1

In another operation of Epoch Smoothing and Combining short epochs are duplicated and extended into a following region with Epoch Length=200, which is indicative of an absence of triggers. The conditions for executing this operation are:

$EpochLog.Length_1=200$ AND $(EpochLog.Length_0<80$ OR $EpochLog.Length_0>200)$

When these conditions are met the following modifications are performed:

If $EpochLog.Length_1<50$

Shift log entries with indicies>=1 three slots higher $EpochLog.Length_1=EpochLog.Length_0$ $EpochLog.Length_2=EpochLog.Length_0$ $EpochLog.Length_3=EpochLog.Length_0$ $EpochLog.Length_4=200-3*EpochLog.Length_0$ $EpochLog.Location_1=EpochLog.Location_0+EpochLog.Length_1$ $EpochLog.Location_2=EpochLog.Location_1+EpochLog.Length_2$ $EpochLog.Location_3=EpochLog.Location_2+EpochLog.Length_3$ $EpochLog.Location_4=EpochLog.Location_3+EpochLog.Length_4$ $EpochLog.EstRms_1=EpochLog.EstRms_4$ $EpochLog.EstRms_2=EpochLog.EstRms_4$ $EpochLog.EstRms_3=EpochLog.EstRms_4$

N=N+3

If $EpochLog.Length_1<80$

Shift log entries with indicies>=1 two slots higher $EpochLog.Length_1=EpochLog.Length_0$ $EpochLog.Length_2=EpochLog.Length_0$ $EpochLog.Length_3=200-2*EpochLog.Length_0$ $EpochLog.Location_1=EpochLog.Location_0+EpochLog.Length_1$ $EpochLog.Location_2=EpochLog.Location_1+EpochLog.Length_2$ $EpochLog.Location_3=EpochLog.Location_2+EpochLog.Length_3$ $EpochLog.EstRms_1=EpochLog.EstRms_3$
$EpochLog.EstRms_2=EpochLog.EstRms_3$
$N=N+2$
If $EpochLog.Length_1>200$
Shift log entries with indicies>=1 one slot higher
$EpochLog.Length_1=EpochLog.Length_0$
$EpochLog.Length_2=200-(EpochLog.Length_0-200)$
$EpochLog.Location_1=EpochLog.Location_0+(EpochLog.Length_1-200)$
$EpochLog.Location_2=EpochLog.Location_1+EpochLog.Length_2$
$EpochLog.EstRms_1=EpochLog.EstRms_2$
$N=N+1$ In one embodiment, at the conclusion of Epoch Smoothing and Combining function 27 the values of $EpochLog.Location_0$ and $EpochLog.Length_0$ are passed to Primary Epoch Analysis unit 30. After the Primary and Secondary Epoch Analyses are completed all of the entries in EpochLog 28 are copied to RawEpochLog 26, the entry with index 0 is removed from the RawEpochLog (other entries are shifted one slot lower to fill the space and the length of the log is reduced by one). Processing then resumes with the next speech sample at the top left of the Epoch Locator illustrated in FIG. 3.

Figure 4:
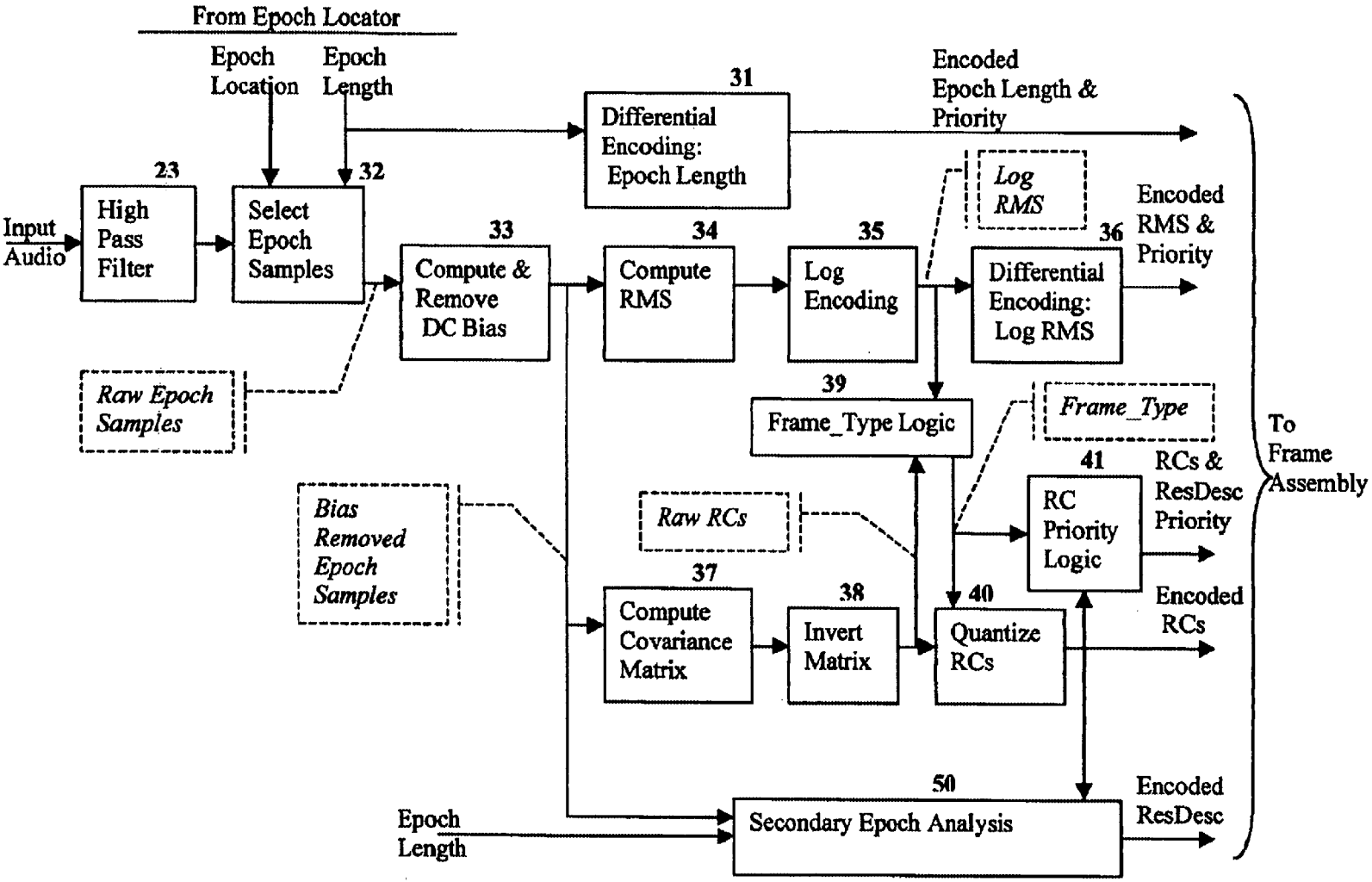
FIG. 4 illustrates a signal flow diagram of Primary Epoch Analysis operations in the Encoder illustrated in FIG. 1.

Primary Epoch Analysis unit 30 is illustrated in FIG. 4. In one embodiment the Differential Encoding of Epoch Length 31 operates on the Epoch Length value for the current frame and the Epoch Length value, Previous_Epoch_Length, from the previous frame to produce a 3-bit Differential Epoch Length value and in certain circumstances an 8-bit Encoded Epoch Length value created from the Epoch Length as follows:

RawEL_difference = Epoch Length − Previous_Epoch_Length (Eq. 16)

Differential Epoch Length = {RawEL_difference + 3 if − 3 < RawEL_difference < 3{7 otherwise

Bits in Differential Epoch Length = 3

Bits in Encoded Epoch Length = {0 if Differential Epoch Length < 7 {8 otherwise Encoded Epoch Length = {Epoch Length if 16 <= Epoch Length <= 200
{Epoch Length − 231 if 232 <= Epoch Length <= 246
{Epoch Length − 46 if 247 <= Epoch Length <= 300

The Differential Epoch Length, #Bits in Differential Epoch Length, and Priority=0 are sent to Frame Assembly unit 60 described below. The Encoded Epoch Length, #Bits in Encoded Epoch Length, and Priority=0 are also sent to Frame Assembly unit 60 described below.

In one embodiment an operation in the Primary Epoch Analysis unit 30 illustrated in FIG. 4 is High Pass Filter 23 which is the same as that illustrated in FIG. 3 and Eq. 12 with its output being the signal $\{p_n\}$. Select Epoch Samples function 32 uses the Epoch Location and Epoch Length provided by Epoch Smoothing and Combining function 27 to extract samples from $\{p_n\}$ for analysis. Since the Epoch Length provided may have 200 added to it to flag a double epoch, an Actual_Epoch_Length is first constructed as:

Actual_Epoch_Length={Epoch Length if Epoch Length<200
{Epoch Length−200 otherwise Then the raw epoch samples $\{e'_k\}$ are selected from $\{p_n\}$ to include the epoch defined by the input parameters plus 12 extra samples. The samples selected are offset by 5 samples from those defined by the input parameters to account for triggering typically occurring a few samples into the pulse that drives the epoch. $\{e'_k\}$ is selected according to the following equation:

$$e'_k=P_{EpochLocation+k-17-Actual_Epoch_Length}$$

for $k$=0,1, . . . ,Actual_Epoch_Length+11 (Eq. 17)

Compute and Remove Epoch Bias operation 33 operates as follows on the Raw Epoch Samples $\{e'_k\}$ to produce the Bias Removed Epoch Samples $\{e_k\}$ as follows:

$$dcb=\left(\sum_{k=0}^{\text{Actual_Epoch_Length}+11} e'_k\right)\Big/(\text{Actual_Epoch_Length}+12) \quad \text{(Eq. 18)}$$

$$e_k=e'_k-dcb \text{ for } k=0,1,\ldots,\text{Actual_Epoch_Length}+11 \quad \text{(Eq. 19)}$$

Compute RMS operation 34 determines the RMS (root mean square) of the signal $\{e_k\}$ as follows:

$$RMS=\left[\left(\sum_{k=0}^{\text{Actual_Epoch_Length}-1} e_{k+12}*e_{k+12}\right)\Big/(\text{Actual_Epoch_Length})\right]^{1/2} \quad \text{(Eq. 20)}$$

In one embodiment Log Encoding 35 of the RMS operates according to the following equation to produce the LogRMS as an integer in the range 0 to 31:

$$LogRMS=Integer(2.667*\ Log_2(RMS)) \quad \text{(Eq. 21)}$$

LogRMS{31 if LogRMS>31
{LogRMS otherwise (Eq. 22)

In one embodiment Differential Encoding of the LogRMS 36 operates on the RMS value for the current frame and the LogRMS value, Previous_LogRMS, from the previous frame to produce a 2-bit Differential LogRMS value and in certain circumstances a 5-bit Absolute LogRMS value as follows:

RawRMS_difference = LogRMS − Previous_LogRMS (Eq. 23)

Differential LogRMS = {RawRMS_difference + 1 if − 1 < RawRMS_difference < 1{3 otherwise

Bits in Differential LogRMS = 2

Bits in Differential LogRMS = {0 if Differential LogRMS < 3 {5 otherwise

The Differential LogRMS, #Bits in Differential LogRMS, and Priority=0 are sent to Frame Assembly unit 60 described below. The Absolute LogRMS, #Bits in Absolute LogRMS, and Priority=0 are also sent to Frame Assembly unit 60 described below.

In one embodiment Compute Covariance Matrix operation 37 operates on the Bias Removed Epoch Samples $\{e_k\}$ to create a 12×12 covariance matrix, PHI, and a 12×1 vector, PSI, for the current epoch. This operation is well-known prior art for which a discussion may be found in Deller, John R., Hansen, John H. L., Proakis, John G., *Discrete Time Processing of Speech Signals*, pp292–296, IEEE Press, New York, N.Y., 1993. Since the matrix PHI is symmetric about the diagonal, only the lower triangular half need be computed. The present invention implements this technique as follows:

$$PHI_{r,c} = \left( \sum_{k=11}^{\text{Actual_Epoch_Length}+10} e_{k-c} * e_{k-r} \right) \quad \text{(Eq. 24)}$$

for $r = 0, 1, \ldots, 11$ and $c = 0, 1, \ldots, r$ $$PSI_c = \left( \sum_{k=12}^{\text{Actual_Epoch_Length}+11} e_{k-c-1} * e_k \right) \quad \text{(Eq. 25)}$$

for $c = 0, 1, \ldots, 11$

PHI and PSI are passed to Invert Matrix operation 38 which employs the iterative Choleski decomposition method to produce 12 Reflection Coefficients (RCs) according to the following procedure which is well-known prior art (see for example Deller, Hansen & Proakis, 1993, pp296–313). In this procedure the constant eps=0.0001 is used to detect a singular or near singular matrix which has no inverse. In this case the technique terminates prior to completing the computation of all 12 RCs and sets the remaining RCs to zero. The procedure is given in pseudo C programming code:

```
for(j=0; j<12; j++) {                                   (Eq. 26)
    for(k=0; k<j; k++) {
        save = PHI[j][k] * PHI[k][k];
        for(i=j; i<12; i++) PHI[i][j] = PHI[i][j] - PHL[i][k] * save;
    }
    if(|PHI[j][j] | < eps) break;
RC[j] = PSI[j];
for(k=0; k<j; k++)          RC[j] = RC[j] - RC[k] * PHI[j][k];
PHI[j][j] = 1.0 / PHI[j][j];
RC[j] = RC[j] * PHI[j][j];
RC[j] = Minimum(0.986,RC[j]);
RC[j] = Maximum(-0.986,RC[j]);
}
if(|PHI[j][j]| <eps)          for(i=j; i++) RC[i] = 0;
```

In one embodiment the resulting 12 RC values each lie in the range −0.986 to 0.986. These 12 RC values are passed to FrameType Logic 39 for determination of the type of channel quantization to use and to Quantize RCs process 40 for the actual channel encoding.

In one embodiment FrameType Logic 39 examines the current frame's LogRMS value and the value of $RC_0$ to determine if a full frame (12 RCs plus Residue Descriptor) or a half frame (6 RCs with no Residue Descriptor) should be forwarded to the Decoder. This distinction is made to conserve significant bandwidth at the cost of minor signal degradation at the Decoder output. In the absence of bandwidth constraints it would be desirable to use full frames for all output. Each frame is initially assumed to be a half frame. The condition for declaring a full frame in FrameType Logic 39 employs a constant RMSThold which for typical telephone digital signals is advantageously set to 20. Higher values may be used with a resultant loss of signal quality at the Decoder output. Lower values of RMSThold result in a higher channel bandwidth and increased signal quality at the Decoder output. The condition implemented for declaring a full frame type in FrameType Logic 39 is:

$$RC0 >= 0 \text{ AND } \text{Log}RMS > RMSThold \quad \text{(Eq. 26a)}$$

Quantize RCs process 40 encodes the Raw RCs as created in Eq. 26 into integer values on limited ranges suitable for transmission with a minimal number of bits. Techniques for such a process are well-known in the prior art. See for example the discussion in O'Shaughnessy, Douglas, *Speech Communication: Human and Machine*, p. 356, Addison-Wesley, New York, N.Y., 1987.

In one embodiment the first two RCs ($RC_0$ and $RC_1$) are encoded by quantizing the log area ratios of the RCs rather than the RCs themselves. This log area ratio encoding provides more resolution when the RC values are near +1 or −1, the regions in which small changes in RC value have the greatest perceptual effects. The Log area ratio function is given as:

$$Lar_j = \text{Log}_e((1+RC_j)/(1-RC_j)) \quad \text{(Eq. 27)}$$

The remaining RCs are encoded linearly from their Raw values. Quantize RCs process 40 computes both the encoded values {$qv_j$, for j=0 to 11} for transmission and the reconstructed quantized RCs {$qRC_j$, for j=0 to 11} that equal the RCs that will be reconstructed in the Decoder.

In one embodiment the Quantization process constrains each $RC_j$ to a predetermined range given by the values $HiClamp_j$ and $LowClamp_j$ as shown in Table 2 below.

TABLE 2

RC clamping limits

| j | 0 | 1 | 2 | 3 |
|---|---|---|---|---|
| HiClamp | 0.986 | 0.986 | 0.9 | 0.9 |
| LoClamp | −0.986 | −0.986 | −0.9 | −0.9 |
| j | 4 | 5 | 6 | 7 |
| HiClamp | 0.9 | 0.75 | 0.75 | 0.75 |
| LoClamp | −0.9 | −0.9 | −0.75 | −0.75 |
| j | 8 | 9 | 10 | 11 |
| HiClamp | 0.75 | 0.75 | 0.7 | 0.7 |
| LoClamp | −0.75 | −0.75 | −0.7 | −0.7 |

The number of bits used to encode each $RC_j$ is a function of j and the frame type: full or half as shown in Table 3 below.

TABLE 3

Bit Allocations for RCs

| J | 0 | 1 | 2 | 3 |
|---|---|---|---|---|
| BitsFull | 7 | 7 | 6 | 6 |
| BitsHalf | 6 | 6 | 5 | 5 |
| J | 4 | 5 | 6 | 7 |
| BitsFull | 5 | 5 | 4 | 4 |
| BitsHalf | 4 | 4 | 0 | 0 |
| J | 8 | 9 | 10 | 11 |
| BitsFull | 4 | 4 | 3 | 3 |
| BitsHalf | 0 | 0 | 0 | 0 |

The Process for quantizing and encoding $RC_0$ and $RC_1$ is given below:

$$RC_j = \text{Maximum}(LoClamp_j, RC_j) \quad \text{(Eq. 27a)}$$
$$RC_j = \text{Minimum}(HiClamp_j, RC_j)$$

-continued $$qv_j = \{\text{Integer}(12.57 * Lar_j) \text{ for full frames}$$
$$\{\text{Integer}(6.285 * Lar_j) \text{ for half frames}$$
$$a_j = \{\exp(qv_j/12.57) \text{ for full frames}$$
$$\{\exp(qv_j/6.285) \text{ for half frames}$$
$$qRC_j = (a_j - 1)/(a_j + 1)$$

This encoding results in $qv_j$ values which require 7 bits for transmission in full frames and 6 bits for transmission in half frames.

The process for quantizing and encoding $RC_2$ through $RC_5$ is given below:

$$RC_j = \text{Maximum}(LoClamp_j, RC_j) \quad \text{(Eq. 27b)}$$
$$RC_j = \text{Minimum}(HiClamp_j, RC_j)$$
$$qv_j = \{\text{Integer}((2 ** BitsFull_j - 1) * (RC_j - LoClamp_j)/$$
$$(HiClamp_j - LoClamp_j)) \text{ for full frames}$$
$$\{\text{Integer}((2 ** BitsHalf_j - 1) * (RC_j - \text{LoClamp}_j)/$$
$$(HiClamp_j - LoClamp_j)) \text{ for half frames}$$
$$qRC_j = \{LoClamp_j + (HiClamp_j - LoClamp_j) * (qv_j + .5)/$$
$$(2 ** BitsFull_j - 1)$$
$$\{\text{for full frames}$$
$$\{LoClamp_j + (HiClamp_j - LoClamp_j) * (qv_j + .5)/$$
$$(2 ** BitsHalf_j - 1)$$
$$\{\text{for half frames}$$

This encoding results in $qv_j$ values which require $BitsFull_j$ bits for transmission in full frames and $BitsHalf_j$ bits for transmission in half frames.

The process for quantizing and encoding $RC_6$ through $RC_{11}$ is given below:

$$RC_j = \text{Maximum}(LoClamp_j, RC_j) \quad \text{(Eq. 27c)}$$
$$RC_j = \text{Minimum}(HiClamp_j, RC_j)$$
$$qv_j = \{\text{Integer}((2 ** BitsFull_j - 1) * (RC_j - LoClamp_j)/$$
$$(HiClamp_j - LoClamp_j))$$
$$\{\text{for full frames}$$
$$\{0 \text{ for half frames}$$
$$qRC_j = \{LoClamp_j + (HiClamp_j - LoClamp_j) * (qv_j + .5)/$$
$$(2 ** BitsFull_j - 1)$$
$$\{\text{for full frames}$$
$$\{0 \text{ for half frames}$$

This encoding results in $qv_j$ values which require $BitsFull_j$ bits for transmission in full frames and 0 bits for transmission in half frames.

The reconstructed quantized RCs $\{qRC_j$, for j=0 to 11$\}$ are passed RC Priority Logic 41 and to Secondary Epoch Analysis 50. The encoded values $\{qv_j$, for j=0 to 11$\}$ are passed to Frame Assembly unit 60.

RC Priority Logic 41 determines the importance of the RCs in a particular frame to the quality of the reconstructed speech at the Decoder. In one embodiment frames are assigned a priority in the range 0 to 15. Frames with minimal importance are assigned a priority of 15, while frames of greatest importance are assigned a priority of 0. The RC Priority Logic computes two measures of distance on the qRCs: rcdif and rcdif0. The distance is computed between the current frame and last frame that would have been transmitted to the Decoder when only priorities of 2 or less are transmitted. Whenever a frame is encountered that is assigned a priority of 2 or less its $\{qRC_j\}$ and $\{qv_j\}$ values become the reference set $\{ref_qRC_j\}$ and $\{ref_qv_j\}$ for computing distance and hence priorities in succeeding frames. The distance measures are computed as follows:

$$rcdif = \sum_{k=0}^{11} |qv_k - \text{ref_}qv_k| \quad \text{(Eq. 28)}$$

$$rcdif0 = |qRC_0 - ref_qRC_0| \quad \text{(Eq. 29)}$$

Priority Logic 41 then employs an empirically derived constant RCDropTH which is used to tune the overall data rate range of the system. In one embodiment RCDropTH is set to 110 which results in average channel data rates on typical telephone conversations of approximately 1600 bps when only parameters with priority of 2 or less are transmitted and average rates of approximately 3200 bps when all parameters are transmitted through the channel. The priority value to be assigned to RCs in the current frame is determined as follows:

Rcdimport=rcdif/RCDropTH

Rc0import=rcdif0/(RCDropTH/700)

Rcimport={Maximum(Rcdimport, Rc0import) if LogRMS>
RMSThold

{Rcdimport otherwise

Rcpriority=(2+15* (1-Rcimport))

Rcpriority=Maximum (2, Rcpriority)

Rcpriority=Minimum (15, Rcpriority)

If (current frame is full and previous frame was half OR current frame is half and previous frame was full)

$$Rcpriority = \{1 \text{ if } LogRMS <= RMSThold \quad \text{(Eq. 30)}$$
$$\{0 \text{ otherwise}$$

The Rcpriority is forwarded to the Frame Assembly unit 60.

Secondary Epoch Analysis 50 computes a Residue Descriptor parameter that is transmitted in full frames only and acts as a fine tuning of the Epoch Length by controlling the position at which the Decoder places the excitation pulse in the reconstructed Epoch's excitation.

Figure 5:
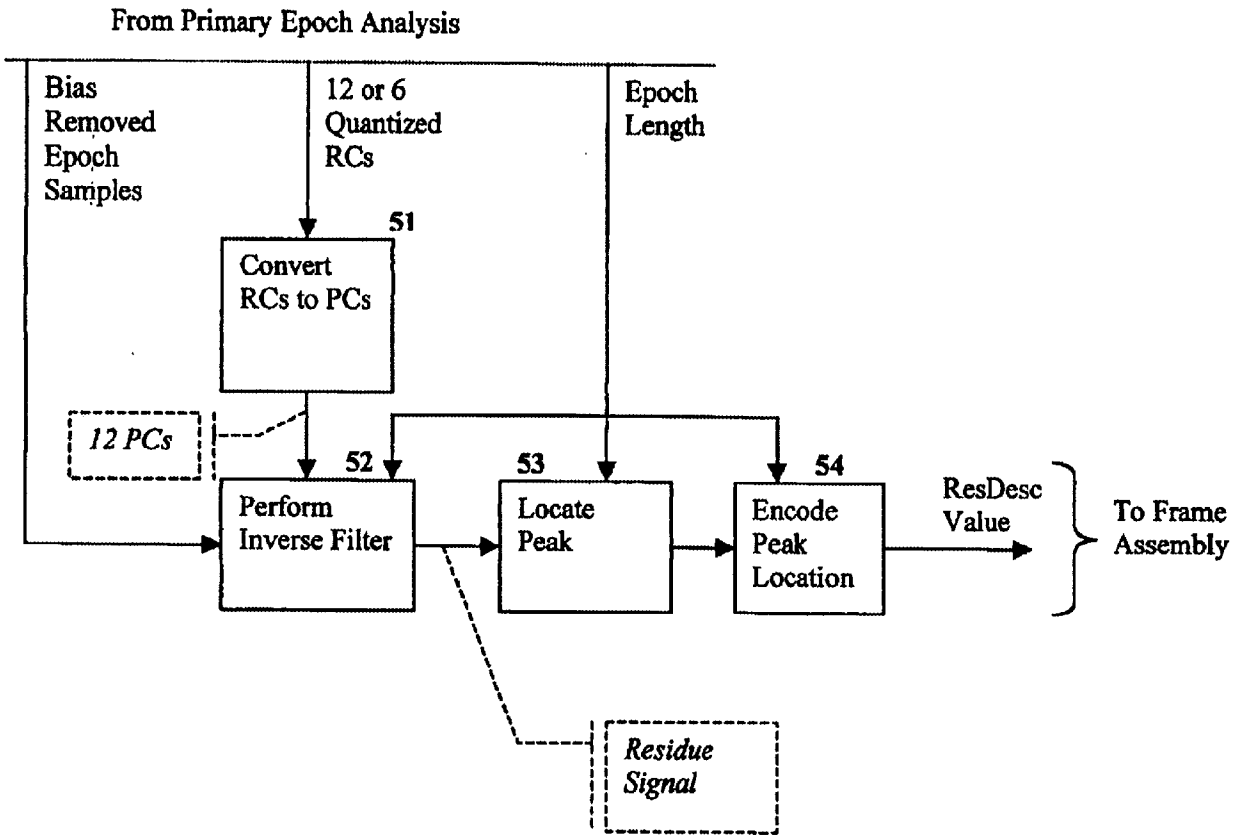
FIG. 5 illustrates a signal flow diagram of a Secondary Epoch Analysis portion of the Encoder illustrated in FIG. 1.

Secondary Epoch Analysis 50 proceeds as shown in FIG. 5 in which the quantized RCs $\{qRC_j\}$ as computed by Quantize RCs process 40 are converted to predictor coefficients $\{pc_j$; for j=0, . . . ,11$\}$ by Convert RCs to PCs operation 51. This operation is carried out as follows:

$$pc_0 = qRC_0; \quad \text{(Eq. 31)}$$
$$\text{for}(i = 1; i < 12; i++)\{$$
$$\text{for}(j = 0; j < i; j++)\, temp_j = pc_j - qRC_i * pc_{i-j-1};$$
$$\text{for}(j = 0; j < i; j++)\, pc_j = temp_j;$$
$$pc_i = qRC_i;$$
$$\}$$

The predictor coefficients are then used to inverse filter the Bias Removed Epoch Samples $\{e_k\}$ to produce a residue signal $\{r_k\}$. This is accomplished in Perform Inverse Filter operation 52 as follows:

$$r_k = e_k - \sum_{j=0}^{11} pc_j * e_{k-j-1} \quad \text{(Eq. 32)}$$

for $k = 12, 13, , \text{Actual_Epoch_Length} + 11$

The residue $\{r_k\}$ represents the excitation signal required to drive a filter built with the predictor coefficients to reconstruct the input signal. The Decoder will attempt to approximate this residue in the process of reconstructing the speech. The only parameter derived from the residue is and estimate of the location of the pulse within the epoch. This is determined as follows by Locate Peak function 53:

ResPeak=0;
PeakLoc=0;
for (j=0; j<Actual_Epoch_Length; j++)
if($-r_j$>ResPeak){ResPeak=$-r_j$; PeakLoc=j;}

The Peak location, PeakLoc, is encoded for transmission in 4 bits by the following actions in Encode Peak Location operation 54:

If($PeakLoc$ > Actual_Epoch_Length/2)

$ResDesc$ = {$PeakLoc$ − Actual_Epoch_Length
If $PeakLoc$ > Actual_Epoch_Length/2
{$PeakLoc$ otherwise
$ResDesc$ = Maximum($ResDesc$, −7)
$ResDesc$ = Minimum($ResDesc$, 8)
$ResDesc$ = $ResDesc$ + 7

The resulting range for ResDesc is 0 to 15, which can be encoded in 4 bits. ResDesc is forwarded to Frame Assembly unit 60 where it assumes the priority, Rcpriority, from Eq. 30. Its number of bits will be 4 in full frames and 0 in half frames.

Frame Assembly unit 60 of FIG. 1 is the final Encoder operation in preparing a frame of data for transmission. Two modes of operation are possible for this module depending on whether or not a network traffic management function is co-resident with the Encoder or remotely located.

In the case of a co-resident traffic manager (e.g. a traffic manager to which the Encoder communicates over a high bandwidth channel) the Frame Assembly process assembles into a standard format and forwards parameter values, parameter encoding specifications (number of bits per parameter) and parameter priorities to the traffic manager. The speech data in this format requires approximately 56 kbps for transmission to the traffic manager. The traffic manager then selects a priority level that provides the maximum output speech quality for the available bandwidth. After a priority has been selected, the traffic manager selects only those bits corresponding to encoded parameter values with priorities at or below the requested priority value for transmission. The priorities themselves and the number of bits per parameter are not forwarded over the channel. The resulting transmission data rate varies from about 1600 bps to 3200 bps depending on the priority level employed. There are many factors beyond the scope of the present invention that may be brought to bear in setting the available bandwidth for a given speech channel. They include network congestion, bandwidth cost, and the channel user's requested (contracted for) quality of service. It will be appreciated that in one embodiment the priority level governing transmission rate may be dynamically varied from frame to frame to meet rapidly changing network conditions.

In the case of a remotely located traffic manager, the traffic manager forwards a requested priority level to the Encoder, which then performs the bit stripping and packing operation itself to produce a low-rate bit stream for transmission. Since this bit stream no longer has priority information included, the network cannot further modify it.

A standard format frame with priority and bit size information included is a block of 64 bytes laid out as in Table 4 below which gives the possible values for each byte in the frame.

TABLE 4

Possible Values for Each Entry in Parameter Frame

| Parameter Name | Priority | # Bits | Value |
|---|---|---|---|
| Include RCs:IRC | 0 | 1 | 0, 1 |
| EpochLen Delta Flag:EDF | 0 | 3 | 0 -> 7 |
| RMS Delta Flag:RDF | 0 | 2 | 0 -> 3 |
| EpochLength | 0 | 0, 8 | 0 -> 255 |
| RMS | 0 | 0, 5 | 0 -> 31 |
| RC1 | 0 -> 15 | 6, 7 | 0 -> 127 |
| RC2 | 0 -> 15 | 6, 7 | 0 -> 127 |
| RC3 | 0 -> 15 | 5, 6 | 0 -> 63 |
| RC4 | 0 -> 15 | 5, 6 | 0 -> 63 |
| RC5 | 0 -> 15 | 4, 5 | 0 -> 31 |
| RC6 | 0 -> 15 | 4, 5 | 0 -> 31 |
| RC7 | 0 -> 15 | 0, 4 | 0 -> 15 |
| RC8 | 0 -> 15 | 0, 4 | 0 -> 15 |
| RC9 | 0 -> 15 | 0, 4 | 0 -> 15 |
| RC10 | 0 -> 15 | 0, 4 | 0 -> 15 |
| RC11 | 0 -> 15 | 0, 3 | 0 -> 7 |
| RC12 | 0 -> 15 | 0, 3 | 0 -> 7 |
| ResDesc | 0 -> 15 | 0, 4 | 0 -> 15 |
| Unused | 0 | 0 | 0 |
| Unused | 0 | 0 | 0 |
| Unused | 0 | 0 | 0 |
| Unused | 0 | 0 | 0 |

Each of the parameters listed in Table 4 corresponds to some number of bits which may or may not be included the bit stream sent to the Decoder. The designation 0-bits implies that the parameter is not sent at all. The Include RC Flag (IRC) is initially set to 1. When the traffic manager (or Encoder) "drops" RCs based on their priority level the IRC bit is set to 0 to flag the absence of the RCs for the given frame. Note that all RCs and the RescDesc within a given frame have the same priority number, thus all are kept or dropped as a group.

In the case of a remote traffic manager, which has supplied a particular priority level to the Encoder, the following operations are performed in the Encoder to produce the bits sent to the digital transmission medium. These same operations are performed by a co-resident traffic manager operating on the 64 byte frame block.

The Encoder first compares the priority assigned to the RCs and ResDesc in the frame to the requested (or allowed) priority for transmission. If the priority for the RCs for this frame is less than or equal to the requested priority all RCs are to be retained. If the priority for the RCs for this frame is greater than the requested priority all RCs are to be dropped. This determines the value of the IRC bit. Conversion from the frame structure to a bit stream then proceeds from top to bottom in the 64 bytes frame examining each triplet of priority, #bits, and value. If priority is greater than the requested priority the triplet is skipped. If priority is less than or equal to the requested priority the number of bits specified by the # Bits column are extracted from the low end of the Value byte and forwarded to the bit stream. It will be appreciated that this translation in this order to the bit stream results in a bit stream which is uniquely decodable at the receiving end into the individual parameters as discussed below under the Decoder operation. It will also be appreciated that there are other arrangements of the bits which provide unique decodability and may be advantageous in certain other implementations. In particular in environments with noticeable error rates imparted by the digital transmission medium, it will be advantageous to encode the IRC, EDF, RDF, and first bit of RC1 with error detection and correction codes to ensure rapid recovery of frame synchronization after channel errors occur.

Figure 2:
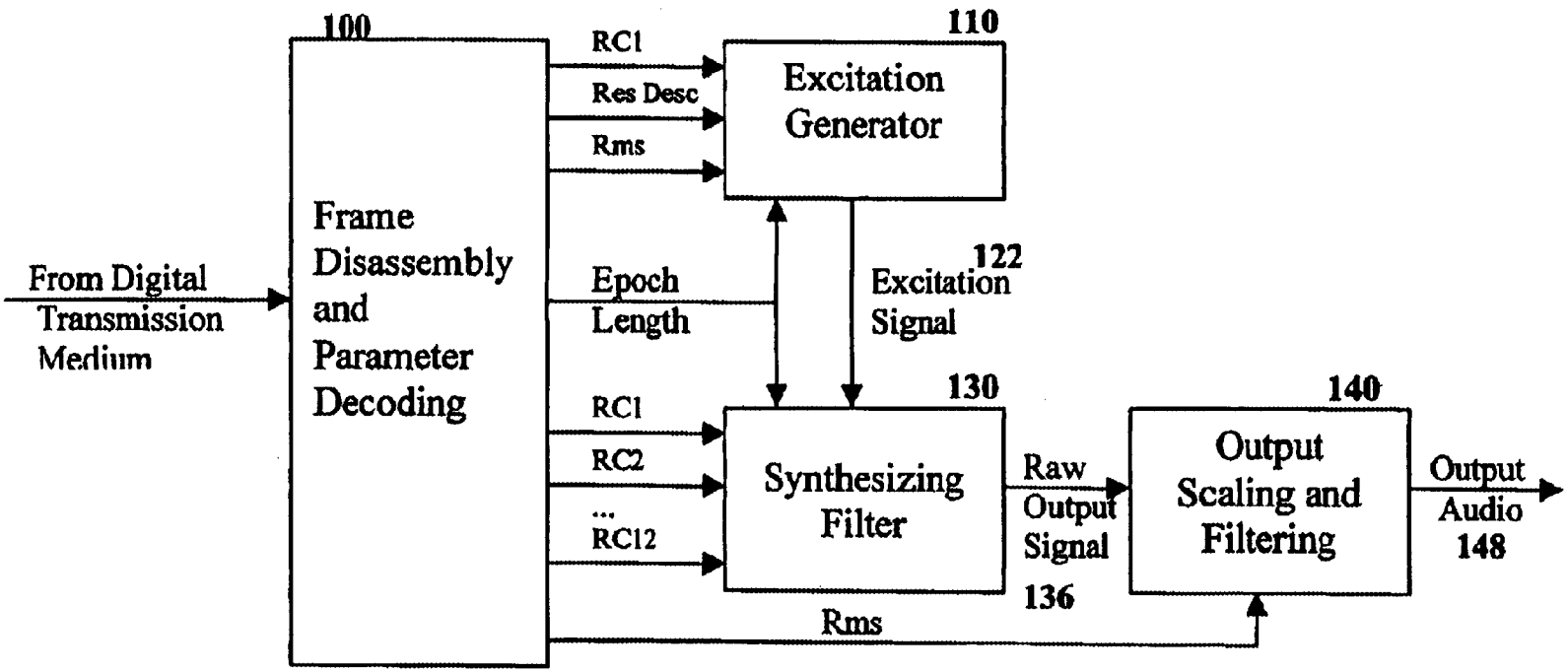
FIG. 2 illustrates a block diagram of one embodiment of a Variable Rate Speech Decoder.

FIG. 2 illustrates a block diagram of a Decoder in one embodiment of the invention. The Decoder consists of Frame Disassembly and Decoding unit 100 to reconstruct parameters from the digital bit stream, Excitation Generator 110 to construct an excitation signal, Synthesizing Filter 130 to filter excitation signal 122 producing Raw Output Signal 136, and Output Scaling and Filtering unit 140 to transform Raw Output Signal 136 into final Output Audio 148. At the receiving (decompression) side the Decoder reconstructs each frame of (typically) 15 parameters for each channel, flags the parameters that are missing (were not sent due to bandwidth limitations over the Frame Relay link), and presents the frame to a Synthesizer for reconstruction of the speech.

Frame Disassembly and Decoding unit 100 accepts the incoming bit stream, disassembles it into individual frames and individual parameters within each frame and decodes those parameters into formats useful for synthesis of speech corresponding to the input Epoch.

The first task in Frame Disassembly is the identification of the total length of the frame and the location of individual parameters in the frame's bit stream. The IRC bit is first examined to determine the presence or absence of RC Block. The next 3 bits are the EDF(Epoch Length Delta Flag). If the EDF is 7 there are 8 bits of Encoded Epoch Length following the RDF. The next 2 bits are the RDF (RMS Delta Flag). If the RDF is 3, then the RMS absolute value is included as 5 bits following either the Epoch Length (if present) or the RDF (if no Epoch Length). These operations have established the length and structure of the ER Header (Epoch_Length RMS Header). The values in the ER Header are now decoded as follows:

$$\begin{aligned}
&\text{Epoch Length} = \text{previous Epoch Length} + \text{EDF} - 3 && \text{if EDF} < 7 \\
&\text{Epoch Length} = \text{ELcode} && \text{if EDF} = 7 \text{ and } 16 <= \text{ELcode} <= 200 \\
&\text{Epoch Length} = \text{ELcode} + 231 && \text{if EDF} = 7 \text{ and ELcode} < 16 \\
&\text{Epoch Length} = \text{ELcode} + 46 && \text{if EDF} = 7 \text{ and ELcode} > 200 \\
&\text{LogRMS} = \text{previous LogRMS} + \text{RDF} - 1 && \text{if RDF} < 3 \\
&\text{LogRMS} = \text{RMScode} && \text{if RDF} = 3
\end{aligned} \tag{Eq. 33}$$

If the IRC bit is 0, the frame ends with the ER Header. Otherwise the frame contains an RC Block with length and format established by the value of the decoded LogRMS and the value of the first bit in the RC Block, which is the sign bit of $RC_0$. If the LogRMS is greater than the RMSThold (as described in conjunction with Eq. 26a above) and the first bit of the RC Block is 0, the RC Block is a full frame containing 62 bits. If the LogRMS is less than or equal to the RMSThold or the first bit of the RC Block is 1, the RC Block is a half frame containing 30 bits.

The individual RCs if present in the frame are decoded from their transmitted values $\{qv_j\}$ to produce the set $\{qRC_j\}$ according to Eqs. 27a, 27b, and 27c above.

The LogRMS is decoded into a linear RMS approximation by using the LogRMS value (an integer on [0,31]) as an index into the following table:

TABLE 5

| | | | | | | | | |
|---|---|---|---|---|---|---|---|---|
| LogRMS | 0 | 1 | 2 | 3 | 4 | 5 | 6 | 7 |
| RMS | 0 | 1 | 2 | 3 | 4 | 5 | 6 | 7 |
| LogRMS | 8 | 9 | 10 | 11 | 12 | 13 | 14 | 15 |
| RMS | 9 | 12 | 15 | 21 | 27 | 35 | 43 | 57 |
| LogRMS | 16 | 17 | 18 | 19 | 20 | 21 | 22 | 23 |
| RMS | 73 | 94 | 126 | 160 | 204 | 267 | 346 | 454 |
| LogRMS | 24 | 25 | 26 | 27 | 28 | 29 | 30 | 31 |
| RMS | 587 | 756 | 984 | 1,245 | 1,606 | 2,072 | 2,646 | 3,387 |

The Epoch Length, RMS, and decoded RCs, $\{qRC_j\}$, along with a flag indicating if the RCs are present or not are passed to Excitation Generator 110, Synthesizing Filter 130, and Output Scaling and Filtering 140 as illustrated in FIG. 2.

Figure 6:
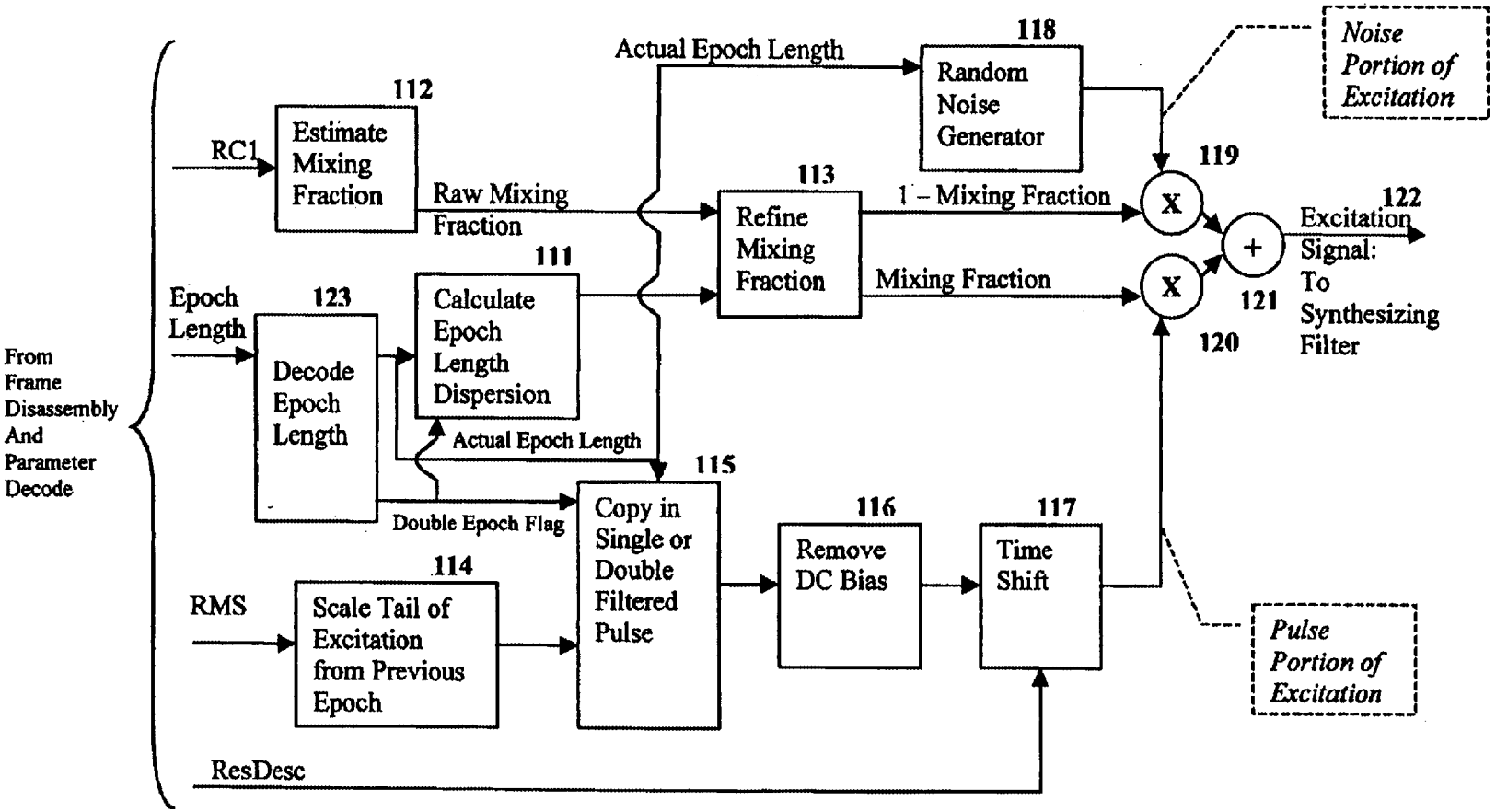
FIG. 6 illustrates a signal flow diagram of an Excitation Generator portion of the Decoder illustrated in FIG. 2.

Excitation Generator 100 illustrated in FIG. 6 begins by decoding the Epoch Length in Decode Epoch Length function 120 to determine the actual number of samples in the Epoch and whether or not the Epoch is a Double. This is accomplished as follows:

$$\begin{aligned}\text{Actual_Epoch_Length} &= \{\text{Epoch Length if Epoch Length} <= 200 \\ &\quad \{\text{Epoch Length} - 200 \text{ otherwise} \\ \text{Double Epoch Flag} &= \{\text{False if Epoch Length} <= 200 \\ &\quad \{\text{True otherwise}\end{aligned} \tag{Eq. 34}$$

Excitation Generator 100 then executes Calculate Epoch Length Dispersion function 111 to calculate an EpochLength Consistency factor that measures the consistency versus dispersion of the successive epoch lengths as follows:

$$\begin{aligned}\text{True Epoch Length} &= \{\text{Actual_Epoch_Length if Double Flag is False} \\ &\quad \{(\text{Actual_Epoch_Length})/2 \text{ otherwise} \\ d1 &= \{|\text{Log(Previous True Epoch Length/True Epoch Length)}| \\ &\quad \{ \text{ if True Epoch Length} < 200 \text{ and} \\ &\quad \{ \text{ Previous True Epoch Length} < 200 \\ &\quad \{2.5 \text{ otherwise} \\ \text{dispersion} &= \text{Previous } d1 + d1 \\ \text{Epoch Length Consistency} &= \{1 - (\text{dispersion}/2) \text{ if dispersion} < 2.0 \\ &\quad \{0 \text{ otherwise}\end{aligned} \tag{Eq. 35}$$

The EpochLength Consistency factor has values near 1.0 for voiced signals and near 0 for unvoiced signals.

The Raw Mixing Fraction is computed in Estimate Mixing Fraction operation 112 from the first RC, $RC_0$, as follows:

$$\begin{aligned}\text{Alpha} = &\ \{.9 && \text{if } RC_0 >= 0.2 \\ &\ \{(RC_0 + 0.4) * 1.5 && \text{if } -0.4 < RC_0 < 0.2 \\ &\ \{0 && \text{else} \\ \text{Raw Mixing Fraction} &= (\text{Alpha} + \text{Previous Alpha})/2\end{aligned} \tag{Eq. 36}$$

The Raw Mixing Fraction has values near 1.0 for voiced signals and near 0 for unvoiced signals.

Refine Mixing Fraction operation 113 combines the Raw Mixing Fraction and EpochLength Consistency to produce a Mixing Fraction as follows:

$$\begin{aligned}&\{(\text{EpochLength Consistency}) * (\text{Raw Mixing Fraction}) \\ &\{ \qquad \text{if Raw Mixing Fraction} < 0.8 \\ \text{Mixing Fraction} = &\{(\text{EpochLength Consistency}) * (\text{Raw Mixing Fraction} + 0.2) \\ &\{ \qquad \text{if } 0.8 < \text{Raw Mixing Fraction} <= 0.9 \\ &\{(\text{EpochLength Consistency}) * (\text{Raw Mixing Fraction} + 0.4) \\ &\{ \qquad \text{if } 0.9 < \text{Raw Mixing Fraction}\end{aligned} \tag{Eq. 37}$$

The pulse portion of the excitation is created by first selecting the final 12 points of the previous unshaped synthesized audio signal {Un} described below. This signal, which is used to provide history to Synthesizing filter 133, needs to be adjusted by the relative gain levels of the previous and current epochs. This is accomplished in Scale Tail of Excitation from Previous Epoch 114 as follows:

$$\begin{aligned}\text{Tail_scale} &= \{PreviousRMS/RMS && \text{if } PreviousRMS/RMS <= 4.0 \\ &\quad \{4.0f && \text{otherwise} \\ exc_j &= \text{Tail_scale} * \text{previous_exc}_{\text{PreviousActual_Epoch_Length}+j} && j = 0, 1, \ldots, 11\end{aligned} \tag{Eq. 38}$$

Next a fixed shape excitation pulse is used to provide the body of the pulse portion of the excitation in Copy Single or Double Pulse operation 115. To this end a fixed excitation source signal, $dkexc_k\}$, is stored in advance as:

$$dkexc_k = \{(-98, -66, -130, -9, -233, 174, -537, 558, -741, 104) \quad k = 0, \ldots 9 \qquad \text{(Eq. 39)}$$
$$\{(477, -578, -669, -5, 554, 643, 443, 200, 70, 29) \quad k = 10, \ldots 19$$
$$\{(13, -29, -83, -126, -81)$$
$$k = 20, \ldots 24$$
$$\{(0, 0, \ldots, 0) \quad k = 25, \ldots 199$$

The excitation signal $\{exe_j\}$ is the filled in according to:

$$\text{(Eq. 40)}$$

$$\underline{\text{If Double Flag is False}}$$
$$exc_{j+12} = dkexc_j \quad j = 0, \ldots, \text{Actual_Epoch_Length} - 1$$
$$\underline{\text{If Double Flag is True}}$$
$$Half1 = \text{Integer}((\text{Actual_Epoch_Length})/2)$$
$$exc_{j+12} = dkexc_j \qquad j = 0, \ldots, Half1 - 1$$
$$exc_{j+12+Half1} = dkexc_j \quad j = 0, \ldots, \text{Actual_Epoch_Length} - Half1 - 1$$

Remove DC Bias operation 116 then removes any DC Bias from the non-tail portion of the pulse excitation as follows:

$$exc_{j+12} = exc_{j+12} - \qquad \text{(Eq. 41)}$$
$$(1/(\text{Actual_Epoch_Length})) \sum_{k=0}^{\text{Actual_Epoch_Length}-1} exc_{k+12}$$
$$\text{for } j = 0, , \text{Actual_Epoch_Length} - 1$$

Time Shift operation 117 employs the Residue Descriptor information to shift the location of the pulse(s) in the excitation to more nearly match the pulse alignment within the epoch in the original residue in the Encoder as follows using a circular shift:

$$exc_{j+12} = exc_{(j+12+ResDesc+2) \bmod (Actual\ Epoch\ Length)} \qquad \text{(Eq. 42)}$$

This completes the creation of the pulsed portion of the excitation. In one embodiment the noise portion of the excitation $\{uvn_k\}$ is created using a Random Number Generator Rrnd( ) that generates numbers uniformly distributed on the range (−32768, +32767).

$$uvn_k = \text{Rrand}(\ )/256 \text{ for } k = 0, \ldots, \text{Actual_Epoch_Length} - 1 \qquad \text{(Eq. 43)}$$

Any convenient Random Number Generator with suitable properties may be used, an exemplary Random Number Generator based on Knuth, D., The Art of Computer Programming, *Fundamental Algorithms,* Vol. 2, p. 27, Addisson-Wesley, New York, 1998, is given in C programming code by:

```
int Rrand( )                                                    (Eq. 44)
{
int the_random
static short y[5] = {−21161, −8478, 30892, −10216, 16950}
static int j = 1, k = 4;
/* The following is a 16 bit 2's complement addition,
with overflow checking disabled* /
y[k] += y[j];
if (y[k] > 32767)y[k] = −(32768 − (y[k] &32767));
if (y[k] < −32768)y[k] = y[k] &32767;
the_random = y[k];
k--; if (k > 0)k = 4;
j--; if (j < 0)j = 4;
return(the_random);
}
```

Final excitation signal 122 is created from the noise signal $\{uvn_k\}$ and pulse portion $\{exc_k\}$ via scaling 119,120 and a summing operation 121 as follows:

$$exc_{j+12} = \text{Mixing Fraction} * exc_{j+12} + \qquad \text{(Eq. 45)}$$
$$(1 - \text{Mixing Fraction}) * uvn_j$$
$$\text{for } j = 0, \ldots, \text{Actual_Epoch_Length} - 1$$

Figure 7:
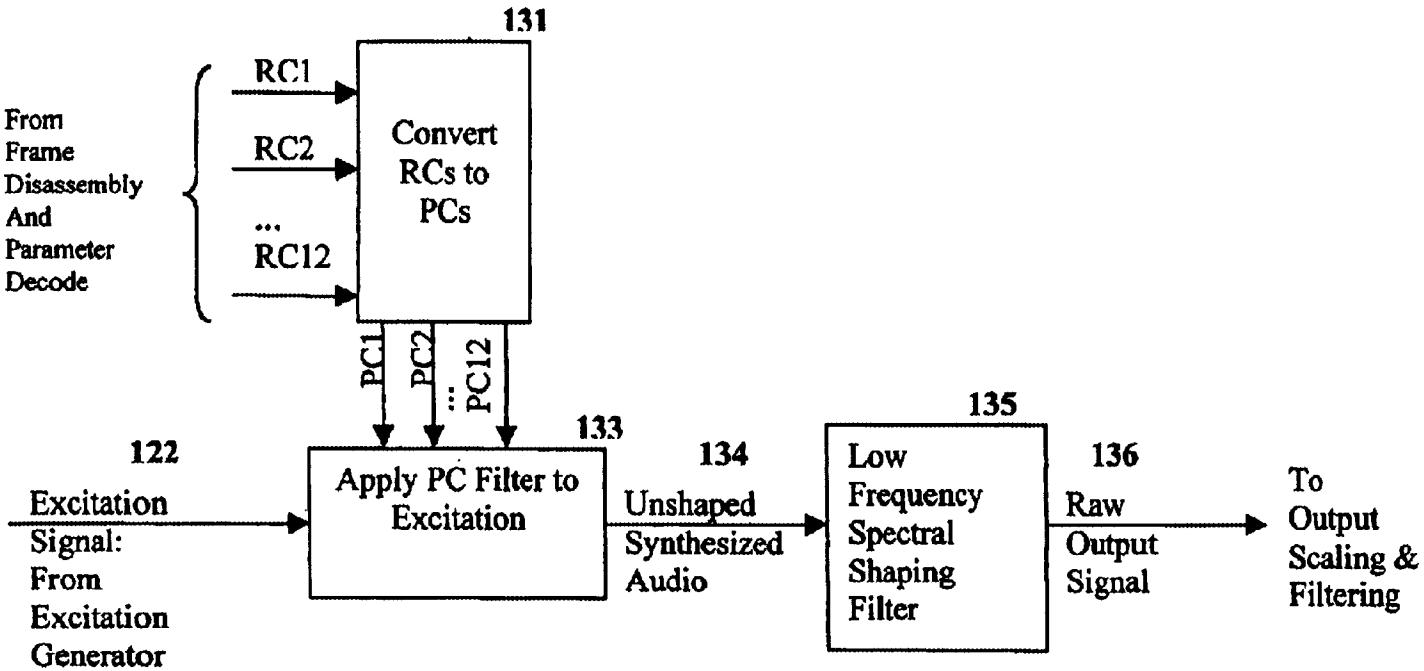
FIG. 7 illustrates a signal flow diagram of Synthesizing Filter segments of the Decoder illustrated in FIG. 2.

Synthesizing Filter 130 is illustrated in FIG. 7 where the first operation, Convert RCs to PCs 131, is accomplished using the technique in the Encoder's Secondary Analysis as specified in Eq. 31. The predictor coefficients, $\{pc_j, j=0, \ldots, 11\}$ are then employed in Apply PC Filter to Excitation operation 133 to filter Excitaiton Signal 122 thus producing Unshaped Synthesized Audio Signal, $\{U_n\}$ 134, according to the following equation:

$$U_n = exc_{n+12} + \sum_{j=0}^{11} pc_j * EXC_{n+12-j-1} \text{ for } n = 0, , \qquad \text{(Eq. 46)}$$
$$\text{Actual_Epoch_Length} - 1$$

Unshaped Synthesized Audio Signal, $\{U_n\}$ 134, is then subjected to a filter with fixed coefficients which boosts low frequencies in Low Frequency Spectral Shaping Filter, 135, to produce Raw Output Signal $\{ros_n\}$ 136 as follows:

$$ros_n = U_n - 2.39399 * U_{n-1} + 2.249895 * U_{n-2} - 0.967 * U_{n-3} + 0.1681 * U_{n-4} + 2.40557 * ros_{n-1} - 2.233958 * ros_{n-2} + 0.9051 * ros_{n-3} - 0.1336 * ros_{n-4} \quad \text{(Eq. 47)}$$

for $n = 0, \ldots, \text{Actual_Epoch_Length} - 1$

Figure 8:
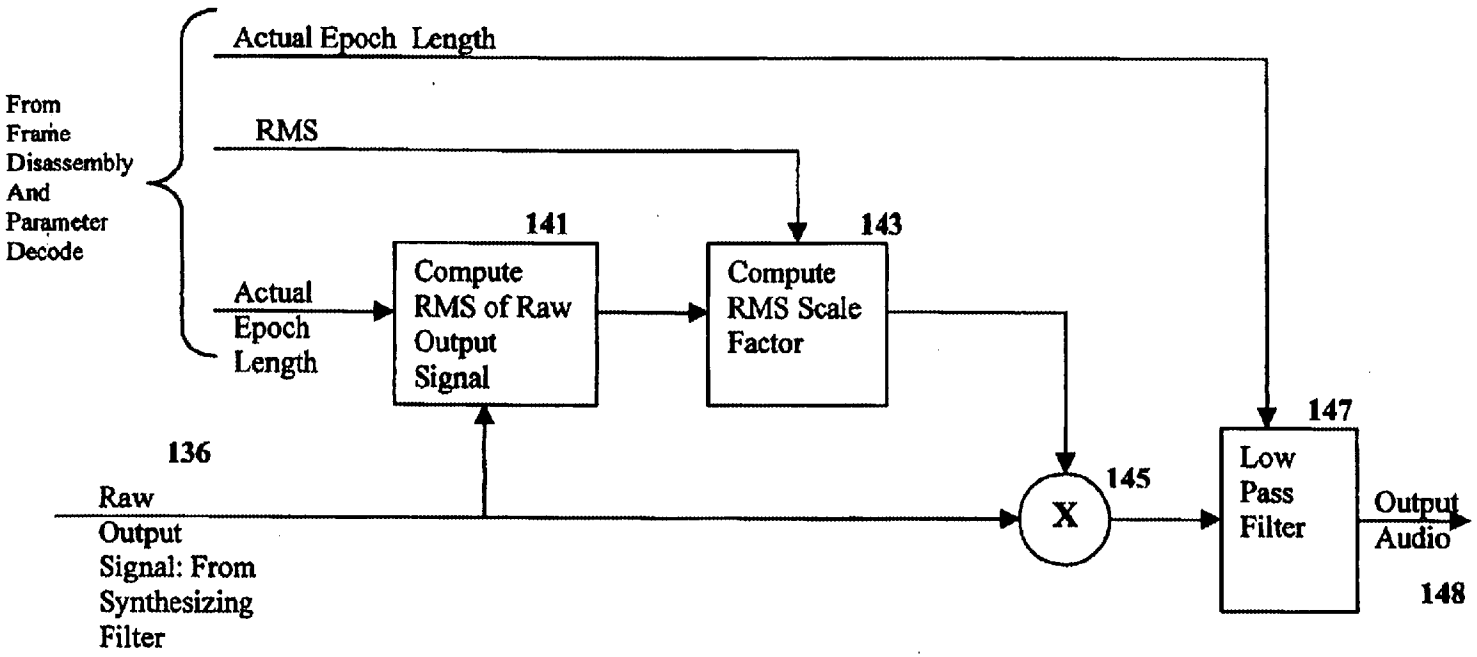
FIG. 8 illustrates a signal flow diagram of an embodiment having Output Scaling and Filtering portions of the Decoder illustrated in FIG. 2.

Output Scaling and Filtering operation 140 is illustrated in FIG. 8 in which the first operation, Compute RMS of Raw Output Signal 141, proceeds to compute Rosrms as follows:

$$Rosrms = \left[\left(\sum_{n=0}^{\text{Actual_Epoch_Length}-1} ros_n * ros_n\right) \Big/ \text{Actual_Epoch_Length}\right] - \quad \text{(Eq. 48)}$$

Compute RMS Scale Factor operation 143 then computes a gain for the current epoch from the input RMS and the Rosrms as follows:

$$\text{Gain} = RMS/\text{Rosrms} \quad \text{(Eq. 49)}$$

The Raw Output Signal is then scaled by the Gain in the operation at 145 to produce the signal $\{gr_n\}$via:

$$gr_n = \text{Gain} * ros_n \text{ for } n = 0, \ldots, \text{Actual_Epoch_Length} - 1 \quad \text{(Eq. 50)}$$

The Gain scaled signal, $\{gr_n\}$, is then filtered by Low Pass Filter 147 to produce final Output Audio, $\{O_n\}$ 148, according to the following equation:

$$O_n = 0.4 * gr_n + 0.2 * gr_{n-1} + 0.5 * O_{n-1} \text{ for } n = 0, \ldots, \text{Actual_Epoch_Length} - 1 \quad \text{(Eq. 51)}$$

The output audio signal can then be forwarded to various mechanisms, such as a Digital to Analog (D/A) converter, amplifier, and speaker, that present the signal to a receiving end-user.

Therefore, a mechanism by which traffic management systems external to an embodiment may meet the needs of rapidly changing network conditions by dynamically varying the bandwidth allocated to a given channel of signal activity, such as speech, or audio activity, with predictable influence on the quality of the reconstructed (received) signal. The present invention can support Quality of Service (QoS) protocols in which end-users trade-off speech quality versus cost of service.

Further, the present invention flags portions of the digital signal as deletable from the bit stream and identifies the effects that each such deletion will have on the output speech quality.

Thus, by meeting the demands of a transmission medium's dynamically changing bandwidth (of transmission rates) by compressing signals in accordance with the dynamically changing bandwidth, communication over the medium is carried out in a manner that maximizes the quality of the reconstructed signal.

The above embodiments can also be stored on a device or medium and read by a machine to perform instructions. The device or medium may include a solid state memory device and/or a rotating magnetic or optical disk. The device or medium may be distributed when partitions of instructions have been separated into different machines, such as across an interconnection of computers.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An encoder comprising:

an epoch locator coupled to a frame assembly, a primary epoch analyzer coupled to the epoch locator, said primary epoch analyzer produces a plurality of bias removed epoch samples, and a secondary epoch analyzer coupled to the primary epoch locator, wherein the encoder compresses a plurality of signals at variable frame rates based on a plurality of prioritized epoch parameters to dynamically reduce signal bandwidth while preserving perceptual signal quality and by combining epochs, by correcting presumed errors in successive epoch lengths, and by extending epoch length patterns indicative of voiced speech areas into unvoiced speech areas, wherein said prioritized epoch parameters are reduced based on each of said plurality of epoch data parameters respective priority, said plurality of epoch parameters including a plurality of reflection coefficients, wherein said primary epoch analyzer converts the plurality of reflection coefficient to a plurality of predictor coefficients, and the plurality of predictor coefficients are used to inverse filter the plurality of bias removed epoch samples to produce a residue signal.

2. The apparatus of claim 1, wherein a transmission rate of the plurality of compressed signals is dynamically set.

3. The apparatus of claim 1, wherein the plurality of compressed signals are speech signals.

4. The apparatus of claim 1, wherein the encoder comprises:

an epoch locator unit;

a first epoch analyzer;

a second epoch analyzer; and a frame assembler unit.

5. The apparatus of claim 4, wherein the plurality of compressed signals in one of half frames and full frames.

6. The apparatus of claim 4, further including a network traffic manager coupled to the encoder.

7. The apparatus of claim 6, wherein the network manager is one of co-resident with the encoder and remotely located relative to the encoder.

8. The apparatus of claim 1, wherein a priority level of each of the plurality of prioritized epoch parameters is based on quality of speech.

9. A decoder comprising:

a frame disassembly and parameter decoding unit coupled to an excitation generator;

a synthesizing filter coupled to the excitation generator; and an output scaling and filtering unit coupled to the synthesizing filter, wherein the decoder decompresses a plurality of compressed signals that were compressed at variable frame rates based on a plurality of prioritized epoch parameters and by combining epochs, by correcting presumed errors in successive epoch lengths, and by extending epoch length patterns indicative of voiced speech areas into unvoiced speech areas, wherein said prioritized epoch parameters are reduced based on each of said plurality of epoch data parameters respective priority, said plurality of epoch parameters including a plurality of reflection coefficients, wherein said decoder approximates a residue signal produced by inverse filtering a plurality of bias removed epoch samples, where the inverse filtering is driven by a plurality of predictor coefficients that are produced by conversion of the plurality of reflection coefficients.

10. The apparatus of claim 9, wherein a transmission rate of the plurality of compressed signals is dynamically set.

11. The apparatus of claim 9, wherein the plurality of compressed signals are speech signals.

12. The apparatus of claim 9, wherein the decoder comprises:

a frame disassembly and parameter decoding unit;

an excitation generator;

a synthesizing filter; and an output scaling and filtering unit.

13. The apparatus of claim 9, wherein the plurality of compressed signals decompressed by the decoder at variable frame rates based on the plurality of prioritized epoch parameters improve transmission during dynamically changing bandwidth while preserving perceptual quality of the signals.

14. A program storage device readable by a machine comprising instructions that cause the machine to:

receive a plurality of signals from a first transmission device;

encode the plurality of signals in a compressed format; and transmit the plurality of signals in a compressed format through a transmission medium at variable frame rates based on a plurality of prioritized epoch parameters and by combining epochs, by correcting presumed errors in successive epoch lengths, and by extending epoch length patterns indicative of voiced speech areas into unvoiced speech areas, to dynamically reduce signal bandwidth while preserving perceptual quality of the signals, wherein said prioritized epoch parameters are reduced based on each of said plurality of epoch data parameters respective priority, said plurality of epoch parameters including a plurality of reflection coefficients, wherein an epoch analyzer converts the plurality of reflection coefficient to a plurality of predictor coefficients, and the plurality of predictor coefficients are used to inverse filter a plurality of bias removed epoch samples to produce a residue signal.

15. The program storage device of claim 14, wherein a transmission rate of the plurality of compressed signals is dynamically set.

16. The program storage device of claim 14, wherein the plurality of signals in a compressed format are speech signals.

17. The program storage device of claim 14, wherein encode instructions cause the machine to:

locate an epoch;

analyze a first epoch;

analyze a second epoch; and assemble a frame.

18. The program storage device of claim 17, wherein the transmit of the plurality of compressed signals is in one of a half frame and a full frame.

19. The program storage device of claim 14, further comprising instructions that cause the machine to:

prioritize each of the plurality of prioritized epoch parameters based on quality of speech.

20. A program storage device readable by a machine comprising instructions that cause the machine to:

receive the plurality of signals in a compressed format through a transmission medium at variable frame rates based on a plurality of prioritized epoch parameters to reduce signal bandwidth and by combining epochs, by correcting presumed errors in successive epoch lengths, and by extending epoch length patterns indicative of voiced speech areas into unvoiced speech areas, while preserving perceptual quality of the signals;

decode the plurality of compressed signals; and transmit the decoded signals to a first receiving device, wherein said prioritized epoch parameters are reduced based on each of said plurality of epoch data parameters respective priority, said plurality of epoch parameters including a plurality of reflection coefficients, wherein said instruction to decode approximates a residue signal produced by inverse filtering a plurality of bias removed epoch samples, where the inverse filtering is driven by a plurality of predictor coefficients that are produced by conversion of the plurality of reflection coefficients.

21. The program storage device of claim 20, wherein a transmission rate of the plurality of compressed signals is dynamically set.

22. The program storage device of claim 20, wherein the plurality of signals in a compressed format are speech signals.

23. The program storage device of claim 20, wherein decode instructions cause the machine to:

disassemble and parameter decode a frame;

generate an excitation;

synthesize and filter; and scale and filter an output.

24. The program storage device of claim 20, wherein the receipt of the plurality of compressed signals at variable frame rates based on the plurality of prioritized epoch parameters improves signal transmission during dynamically changing bandwidth of the transmission medium while preserving perceptual quality of the signals.

25. The program storage device of claim 20, further comprising instructions that cause the machine to:

prioritize each of the plurality of prioritized epoch parameters based on quality of speech.

26. A method comprising:

receiving a plurality of signals from a transmission device;

encoding the plurality of signals in a compressed format;

transmitting the plurality of signals in a compressed format through a transmission medium at variable frame rates based on a plurality of prioritized epoch parameters and by combining epochs, by correcting presumed errors in successive epoch lengths, and by extending epoch length patterns indicative of voiced speech areas into unvoiced speech areas, to reduce signal bandwidth while preserving perceptual quality of the signals, and analyzing a first epoch, wherein said prioritized epoch parameters are reduced based on each of said plurality of epoch data parameters respective priority, said plurality of epoch parameters including a plurality of reflection coefficients, wherein analyzing the first epoch includes converting the plurality of reflection coefficient to a plurality of predictor coefficients, and the plurality of predictor coefficients are used to inverse filter a plurality of bias removed epoch samples to produce a residue signal.

27. The method of claim 26, wherein the variable transmission rate of the plurality of compressed signals is dynamically set.

28. The method of claim 26, wherein the plurality of signals in a compressed format are speech signals.

29. The method of claim 26, wherein encoding comprises:

locating an epoch;

analyzing a second epoch; and assembling a frame.

30. The method of claim 26, wherein the transmitting of the plurality of compressed signals is in one of a half frame and a full frame.

31. The method of claim 26, further comprising:

establishing a priority level of each of the plurality of prioritized epoch parameters based on quality of speech.

32. The method of claim 26, wherein the transmitting of the plurality of compressed signals at variable frame rates based on the plurality of prioritized epoch parameters improves signal transmission during dynamically changing bandwidth of the transmission medium while preserving perceptual quality of the signals.

33. A method comprising:

receiving a plurality of signals in a compressed format through a transmission medium at variable frame rates based on a plurality of prioritized epoch parameters to reduce signal bandwidth and by combining epochs, by correcting presumed errors in successive epoch lengths, and by extending epoch length patterns indicative of voiced speech areas into unvoiced speech areas, while preserving perceptual quality of the plurality of the signals;

decoding the plurality of compressed signals; and transmitting the decoded signals to a receiving device, wherein said prioritized epoch parameters are reduced based on each of said plurality of epoch data parameters respective priority, wherein said plurality of epoch parameters includes a plurality of reflection coefficients, wherein said decoding approximates a residue signal produced by inverse filtering a plurality of bias removed epoch samples, where the inverse filtering is driven by a plurality of predictor coefficients that are produced by conversion of the plurality of reflection coefficients.

34. The method of claim 33, wherein the variable transmission rate of the plurality of compressed signals is dynamically set.

35. The method of claim 33, wherein the plurality of signals in a compressed format are speech signals.

36. The method of claim 33, wherein decoding comprises:

disassembling and parameter decoding a frame;

generating an excitation;

synthesizing and filtering; and scaling and filtering an output.

37. The method of claim 33, wherein the receiving the plurality of compressed signals at variable frame rates based on the plurality of prioritized epoch parameters improves signal transmission during dynamically changing bandwidth of the transmission medium while preserving perceptual quality of the signals.

38. The method of claim 33, wherein the receiving of the plurality of compressed signals is in one of a half frame and a full frame.

39. The method of claim 33, wherein receiving comprises:

prioritizing each of the plurality of prioritized epoch parameters based on quality of speech.

40. An apparatus comprising:

means for encoding a plurality of input signals at variable frame rates, the means for encoding including:

means for identifying input signal segments;

means for extracting a plurality of epoch parameters describing signal segments;

means for associating priority values to the plurality of epoch parameters;

means for combining epochs;

means for analyzing an epoch;

means for correcting presumed errors in successive epoch lengths; and means for extending epoch length patterns indicative of voiced speech areas into unvoiced speech areas, wherein said plurality of epoch parameters includes a plurality of reflection coefficients, wherein said means for analyzing the epoch includes converting the plurality of reflection coefficient to a plurality of predictor coefficients, and the plurality of predictor coefficients are used to inverse filter the plurality of bias removed epoch samples to produce a residue signal.

41. The apparatus of claim 40, wherein the means for encoding comprises compressing the plurality of input signals at variable frame rates based on the plurality of prioritized epoch parameters to dynamically reduce signal bandwidth while preserving perceptual signal quality.

42. An apparatus comprising:

means for decoding a plurality of compressed signals;

the decoding means including:

means for reconstructing parameters from the plurality of compressed signals;

means for constructing an excitation signal;

means for producing a raw output signal; and means for producing a final output signal, wherein the means for decoding comprises decompressing the plurality of compressed signals at variable frame rates based on a plurality of prioritized epoch parameters and by combining epochs, correcting presumed errors in successive epoch lengths, and by extending epoch length patterns indicative of voiced speech areas into unvoiced speech areas, to dynamically reduce signal bandwidth while preserving perceptual signal quality, said plurality of epoch parameters including a plurality of reflection coefficients, wherein said means for decoding further includes approximating a residue signal produced by inverse filtering a plurality of bias removed epoch samples, where the inverse filtering is driven by a plurality of predictor coefficients that are produced by converting the plurality of reflection coefficients.

* * * * *